US008444454B2

(12) United States Patent
Chung-Fat et al.

(10) Patent No.: US 8,444,454 B2
(45) Date of Patent: May 21, 2013

(54) INTERFACE PAD FOR USE BETWEEN AN ABRASIVE ARTICLE AND A SUPPORT TOOL

(75) Inventors: Mervyn Chung-Fat, Neuilly (FR); Thomas Bordes, Orange (FR)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1183 days.

(21) Appl. No.: 12/317,709

(22) Filed: Dec. 23, 2008

(65) Prior Publication Data

US 2009/0233527 A1 Sep. 17, 2009

Related U.S. Application Data

(60) Provisional application No. 61/009,631, filed on Dec. 31, 2007.

(51) Int. Cl.
*B24B 55/06* (2006.01)

(52) U.S. Cl.
USPC ..... 451/28; 451/442; 451/456

(58) Field of Classification Search ..... 451/526, 451/527, 528, 529, 530, 533, 534, 539, 456, 451/442, 449, 28, 26
See application file for complete search history.

(56) References Cited

U.S. PATENT DOCUMENTS

| | | | | |
|---|---|---|---|---|
| 2,749,681 | A | 6/1956 | Reidenbach, el al. | |
| 4,759,155 | A | 7/1988 | Shaw | |
| 4,964,245 | A | 10/1990 | Braasch | |
| 5,007,206 | A | 4/1991 | Paterson | |
| 5,367,839 | A | 11/1994 | Pearce | |
| 5,674,122 | A | 10/1997 | Krech | |
| 5,807,161 | A * | 9/1998 | Manor et al. | 451/442 |
| 5,810,650 | A | 9/1998 | Jöst | |

(Continued)

FOREIGN PATENT DOCUMENTS

| | | | |
|---|---|---|---|
| CN | 2701589 | Y | 5/2005 |
| EP | 1 186 379 | B1 | 2/2006 |

(Continued)

OTHER PUBLICATIONS

International Search Report from PCT/US2008/088160, date of mailing Aug. 18, 2009.

(Continued)

*Primary Examiner* — Robert Rose
(74) *Attorney, Agent, or Firm* — Joseph P. Sullivan; Abel Law Group, LLP

(57) ABSTRACT

The present invention relates to an interface pad for use between an abrasive article and a support tool. In one particular embodiment, an interface pad for use between a perforated abrasive article and a support tool is provided. In general, the interface pads described herein contain apertures and at least one channel configured such that an interface pad can be used between an abrasive article having a particular configuration of apertures and a support tool having different configuration of dust collection apertures. In one embodiment, the interface pads described herein contain apertures and at least one channel configured such that the interface pad can be used between any perforated abrasive article and any support tool with dust extraction capabilities. Abrasive tools which include an interface pad and methods for using the interface pads are also described.

47 Claims, 19 Drawing Sheets

U.S. PATENT DOCUMENTS

| | | | | |
|---|---|---|---|---|
| 5,989,112 | A | 11/1999 | Long et al. | |
| 6,361,424 | B1 * | 3/2002 | Manor et al. | 451/490 |
| 6,413,157 | B1 | 7/2002 | Marton | |
| 7,144,313 | B1 | 12/2006 | Greenwood | |
| 7,244,170 | B2 | 7/2007 | Woo et al. | |
| 7,252,694 | B2 | 8/2007 | Woo et al. | |
| 7,294,158 | B2 | 11/2007 | Welygan et al. | |
| 7,338,355 | B2 * | 3/2008 | Sanders et al. | 451/527 |
| 7,390,244 | B2 | 6/2008 | Woo et al. | |
| 7,393,269 | B2 | 7/2008 | Rambosek et al. | |
| 2003/0003856 | A1 | 1/2003 | Swei | |
| 2003/0032383 | A1 | 2/2003 | Nelson et al. | |
| 2003/0126801 | A1 | 7/2003 | Kamboj | |
| 2005/0095957 | A1 | 5/2005 | Khoury | |
| 2006/0258276 | A1 | 11/2006 | Sung | |
| 2006/0280908 | A1 | 12/2006 | Hoglund | |
| 2007/0028526 | A1 | 2/2007 | Woo et al. | |

FOREIGN PATENT DOCUMENTS

| | | |
|---|---|---|
| GB | 766651 | 1/1957 |
| JP | 7-237131 | 9/1995 |
| SU | 814635 | 3/1981 |
| SU | 1627388 | 2/1991 |

OTHER PUBLICATIONS

Written Opinion of the International Searching Authority from PCT/US2008/088160, date of mailing Aug. 18, 2009.

3M Automotive Aftermarket, 3M™ Hookit™ Purple+Disc, "Multihole Technology, Hookit Purple+", 2 pages (2008).

* cited by examiner

INTERFACE PAD FOR USE BETWEEN AN ABRASIVE ARTICLE AND A SUPPORT TOOL

RELATED APPLICATION

This application claims the benefit of U.S. Provisional Application No. 61/009,631, filed on Dec. 31, 2007.

The entire teachings of the above application(s) are incorporated herein by reference.

BACKGROUND OF THE INVENTION

Abrasive articles can generate a great deal of dust, particularly when used on wood. This dust, also known as swarf, is not only inconvenient, but it also obscures the view of the surface being abraded and can load the abrasive article being used. Many manufacturers therefore sell tools with integral or readily attachable vacuum exhaust systems design to suck away dust as it is formed. This is typically done by applying a vacuum to the back of the tool to which the abrasive article is attached and providing holes through the tool and through the abrasive article for evacuation of the dust as it is generated.

However, there is a problem in that the pattern of dust evacuation holes in the tools is not standardized such that abrasive articles intended for use with one particular tool will often not align with the dust evacuation holes of another tool. For optimal dust extraction, the holes on the abrasive article and its support tool need to be identical and fully aligned. Typically, a user cannot change the hole configuration on the abrasive article while keeping the existing tool without losing performance. To maintain equal performance or improve performance, the user would have to change tools completely.

Currently, many hole configurations are available on the market which are not inter-compatible. This means that the retailer selling to the Do-It-Yourself ("DIY") market must keep at least two different stocks of abrasive articles, in all grit sizes, if the retailer is to be able to service the needs of all his customers. This consumes valuable shelf space which becomes very inconvenient as the number of DIY products for which replacement abrasive materials must be stocked increases.

SUMMARY OF THE INVENTION

The present invention relates to an interface pad for use between an abrasive article and a support tool. In one particular embodiment, an interface pad for use between a perforated abrasive article and a support tool is provided. In general, the interface pads described herein contain apertures and at least one channel configured such that an interface pad can be used between an abrasive article having a particular configuration of apertures and a support tool having different configuration of dust collection apertures. In some embodiments, the interface pads described herein contain apertures and at least one channel configured such that an interface pad can be used between an abrasive article and a support tool to shift an orientation of apertures of the abrasive article relative to an orientation of apertures of the support tool. In one embodiment, the interface pads described herein contain apertures and at least one channel configured such that the interface pad can be used between any perforated abrasive article and any support tool with dust extraction capabilities.

The interface pad for use between an abrasive article, e.g., a perforated abrasive article, and a support tool can include: an abrasive article backing surface defining a plurality of apertures; a plurality of islands underlying the abrasive article backing surface, the islands defining at least one channel in fluid communication with at least two of the plurality of apertures; and a support tool backing surface underlying the plurality of islands.

In one embodiment, the interface pad for use between an abrasive article, e.g., a perforated abrasive article, and a support tool can include: an abrasive article backing surface defining a first plurality of apertures; a first support structure underlying a perimeter of the abrasive article backing surface; at least one additional support structure underlying the abrasive article backing surface, wherein the at least one additional support structure defines at least one channel in fluid communication with at least two of the first plurality of apertures; and a support tool backing surface defining a second plurality of apertures, the support tool backing surface underlying and affixed to at least the first support structure, wherein the at least one channel is also in fluid communication with at least two of the second plurality of apertures.

In yet another embodiment, the interface pad for use between an abrasive article, e.g., a perforated abrasive article, and a support tool can include: an abrasive article backing surface defining a plurality of apertures; a channel-containing layer underlying the abrasive article backing surface, the channel-containing layer defining at least one channel in fluid communication with at least two of the plurality of apertures; and a support tool backing surface underlying the channel-containing layer.

The present invention also relates to abrasive tools that include an abrasive article, an interface pad as described herein, and a support tool. For example, in one embodiment, an abrasive tool includes a perforated abrasive article defining a first plurality of apertures; an interface pad including (i) an abrasive article backing surface defining a second plurality of apertures; (ii) a plurality of islands underlying the abrasive article backing surface, the islands defining at least one channel in fluid communication with at least two of the second plurality of apertures; and (iii) a support tool backing surface underlying the plurality of islands; and a support tool defining a third plurality of apertures; wherein the interface pad is positionable between the perforated abrasive article and the support tool.

In another example embodiment, an abrasive tool includes a perforated abrasive article defining a first plurality of apertures; an interface pad including (i) an abrasive article backing surface defining a second plurality of apertures; (ii) a channel-containing layer underlying the abrasive article backing surface, the channel-containing layer defining at least one channel in fluid communication with at least two of the second plurality of apertures; and (iii) a support tool backing surface underlying the channel-containing layer; a support tool defining a third plurality of apertures; wherein the interface pad is positionable between the perforated abrasive article and the support tool.

By using the interface pads described herein between an abrasive article and a support tool, abrasive articles that were previously not effective when used with certain support tools because of, for example, the difficulty or impossibility of sufficiently aligning perforations in the abrasive articles with dust collection holes in the support tool, can now be used effectively. The interface pads can provide a functional interface between the abrasive article and the support tool by permitting the flow of dust away from the work surface, through the interface pad, and into the dust collection system provided by the support tool. The interface pads described herein contain apertures and at least one channel configured such that an interface pad can be used between an abrasive article having a particular configuration of apertures and a support tool having a different configuration of dust collection apertures. In some instances, the interface pads described herein can be used between any perforated abrasive article and any support tool with dust extraction capabilities. Also, by practicing the present invention, improved dust extraction can be provided of an existing tool without permanent modification of the tool.

In some instances, the interface pad is configured such that the apertures of the interface pad do not need to be completely aligned with the apertures of the abrasive article or the support tool. When the interface pad is so configured, a user of the interface pad need not be concerned with properly orienting the interface pad with the abrasive article or the support tool. By permitting effective abrasion without precise alignment of the apertures, the present invention helps to reduce the significance of user error and helps to improve efficiency in commercial operations by reducing downtime and maintaining consistent abrasive performance.

In one embodiment, the interface pad can be configured to convert a support tool which has a plain, gripping, or adhesive surface to a plain, gripping, or adhesive surface by including a support tool backing surface and an abrasive article backing surface that have particular plain, gripping, or adhesive surfaces. For example, in one embodiment, a support tool with a plain surface can be used with an abrasive article having a loop fastener component by using an interface pad having an adhesive-coated support tool backing surface and a hook fastener abrasive article backing surface. Thus, by practicing the present invention, a wide array of abrasive articles can be used with a wide array of support tools.

In one embodiment, the invention is a kit that includes a perforated abrasive article defining at least one aperture and including an abrasive surface and a backing surface, as shown in the Figures and described supra. The kit also includes at least one interface pad that is fixable to the backing surface of the abrasive article. In a specific embodiment, the perforated abrasive article defines at least two apertures. Optionally, the kit includes at least one interface pad that defines an aperture that, when the interface pad is affixed to the backing surface, causes at least a portion of the perforations of the abrasive article to be in fluid communication with each other when a support tool backing surface is applied to the interface pad. As another option, the kit can include at least two interface pads which, when affixed to the backing surface, and when a support tool is applied to the interface pads, define at least one conduit that provides fluid communication between at least two apertures of the abrasive article.

The present invention also can include a kit containing at least one perforated abrasive article (e.g., a perforated coated abrasive) and at least one interface pad. A kit can include, for example, (a) at least one perforated abrasive article and (b) at least one interface pad wherein each interface pad includes (i) an abrasive article backing surface defining a second plurality of apertures; (ii) a plurality of islands underlying the abrasive article backing surface, the islands defining at least one channel in fluid communication with at least two of the second plurality of apertures; and (iii) a support tool backing surface underlying the plurality of islands; wherein at least one interface pad is positionable between at least one perforated abrasive article and a support tool defining a third plurality of apertures.

The present invention also includes methods for using a perforated abrasive article (e.g., a perforated coated abrasive article) with a support tool. For example, a method for using a perforated abrasive article defining a first plurality of apertures with a support tool defining a second plurality of apertures can include positioning an interface pad described herein between the perforated abrasive article and the support tool.

The present invention also includes methods for abrading a surface using the abrasive tools described herein. For example, in some embodiments, a working surface is contacted with an abrasive tool and swarf is produced. The swarf can be conducted through an abrasive article, through an interface pad, and into a support tool.

Because the interface pads of the present invention can be used to join abrasive articles with support tools that were previously at least partially incompatible, the use of the interface pads can reduce the stock of abrasive articles or support tools that a user must keep on hand. In addition, stores that supply replacement abrasive articles and support tools can keep a reduced inventory of abrasive articles or support tools because of the universal inter-compatibility that the interface pads can provide.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 2A is a support tool backing surface view and FIG. 2B is an abrasive article backing surface view.

FIGS. 3A and 3B include views of the support tool backing surface and FIGS. 3C and 3D include views of the abrasive article backing surface.

FIGS. 4A and 4B include views of the support tool backing surface and FIGS. 4C and 4D include views of the abrasive article backing surface.

FIGS. 5A and 5B include views of the support tool backing surface and FIGS. 5C and 5D include views of the abrasive article backing surface.

FIG. 6A includes a view of a channel-containing layer and FIGS. 6B and 6C include views of an abrasive article backing surface.

FIGS. 7A and 7B include views of a channel-containing layer and FIGS. 7C and 7D include views of an abrasive article backing surface.

DETAILED DESCRIPTION OF THE INVENTION

Figure 1:
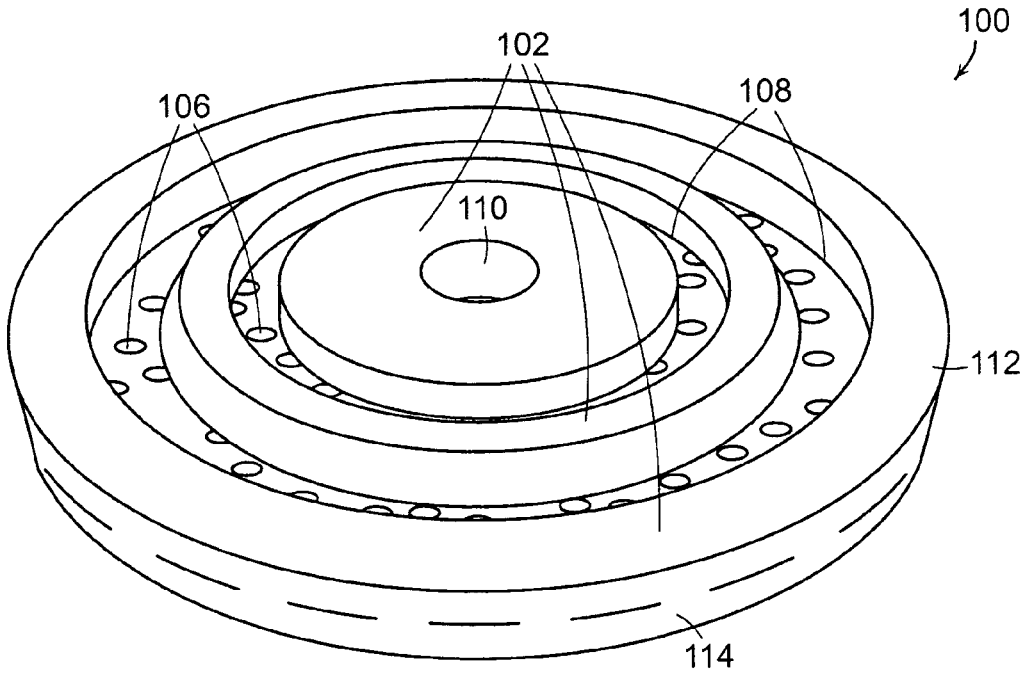
FIG. 1 is a perspective view of an interface pad according to one embodiment of the present invention.

A description of example embodiments of the invention follows.

In one embodiment, an interface pad for use between a perforated abrasive article and a support tool includes (a) an abrasive article backing surface defining a plurality of apertures; (b) a plurality of islands underlying the abrasive article backing surface, the islands defining at least one channel in fluid communication with at least two of the plurality of apertures; and (c) a support tool backing surface underlying the plurality of islands.

"Abrasive article backing surface," as that phrase is used herein, refers to a backing surface to which an abrasive article can be fixed. The abrasive article backing surface can be, for example, a plain surface, a gripping surface, such as, e.g., a hook and loop system, or an adhesive surface. The abrasive article backing surface can be adapted for affixation to a particular style of abrasive article. Thus, in one embodiment, an abrasive article includes a hook or loop fastener component and the abrasive article backing surface includes a compatible hook or loop fastener component. In another embodiment, the interface pad is intended to be mechanically secured to the abrasive article (e.g., via a fastener such as a central nut and threaded spindle system) and the abrasive article backing surface includes a plain surface. In one embodiment, the abrasive article backing surface includes depressions or projections that correspond to depressions or projections, respectively, of the abrasive article to prevent movement or rotation of the interface pad relative to the abrasive article.

In some embodiments, the abrasive article backing surface includes any of a variety of materials known in the art for use in abrasive article back up pads. In some embodiments, the abrasive article backing surface includes a polymer material such as, e.g., a polyurethane. For example, the abrasive article backing surface can include a polymer foam such as, e.g., a polyurethane foam. The polymer foam can be closed cell or open cell polymer foam. In some embodiments, the abrasive article backing surface includes a rubber (natural or synthetic) or a rubber-like material.

In one embodiment, the abrasive article backing surface defines a plurality of apertures. The term "aperture," as used herein, refers to an opening such as hole, for example, a circular, rectangular, triangular, or ring-shaped opening. Apertures can also include elongated holes. For example, the apertures can be arc-shaped.

In some instances, at least a portion of the plurality of apertures of the abrasive article backing surface are positioned for alignment with at least a portion of perforations of a perforated abrasive article. The abrasive article backing surface can also contain a number of apertures of sufficient size and configured for alignment with at least a portion of perforations of just about any perforated abrasive article.

The apertures defined by the abrasive article backing surface can be symmetrically arranged about the abrasive article backing surface. The backing surface can include apertures generally symmetric about one or more axes of symmetry. For example, a disc-shaped abrasive article backing surface can include apertures (e.g., circular, rectangular, triangular, ring-shaped, elongated, or arc-shaped apertures) that are generally radially symmetric. A rectangular backing surface could include apertures generally symmetric about, for example, a longitudinal axis of symmetry.

The interface pad also can include a plurality of islands underlying the abrasive article backing surface. The term "island," as used herein, refers to a structure that has little or no direct lateral contact with other structures. The term "island" includes ring-shaped structures. The islands define at least one channel in fluid communication with at least two of the plurality of apertures defined by the abrasive article backing surface. Preferably, the apertures and the channels are configured such that swarf produced during an abrasion process can be effectively transported through the abrasive article backing surface's apertures and through the channels to reach a support tool's dust extraction system.

The plurality of islands underlying the abrasive article backing surface can include an island underlying a perimeter of the abrasive article backing surface. In one instance, the abrasive article backing surface is disc-shaped and the plurality of islands underlying the abrasive article backing surface includes a generally ring-shaped island underlying a perimeter (i.e., the circumference) of the disc-shaped abrasive article backing surface. An island underlying a perimeter of the abrasive article backing surface can include at least one peninsula underlying the abrasive article backing surface and extending generally from a perimeter of the interface pad toward a center of the interface pad. In some embodiments, one or more peninsulas underlying the abrasive article backing surface define channels in fluid communication with at least two of the plurality of apertures defined by the abrasive article backing surface.

In one embodiment, the plurality of islands defines a plurality of channels in fluid communication with each of the plurality of apertures in the abrasive article backing surface. The channels can be interconnected or not interconnected. Thus, in some embodiments, the plurality of islands also define at least one connection channel in fluid communication with at least two other channels. In some instances, a plurality of apertures is in fluid communication via a single channel. For example, in some embodiments, 2, 3, 4, 5, or more apertures are in fluid communication via a single channel. Thus, at least one channel can be in fluid communication with more than two of the apertures defined by the abrasive article backing surface. In some embodiments, a majority or substantially all of the apertures defined by the abrasive article backing surface are in fluid communication with each other via at least one channel defined by the islands. In other embodiments, all of the apertures defined by the abrasive article backing surface are in fluid communication with each other via at least one channel defined by the islands.

Preferably, at least one channel is non-torturous. For example, at least one channel is generally straight and does not have significant twists, turns, or bends. In one embodiment, at least one channel is non-torturous and the channel does not contain twists, turns, or bends unobservable to the unaided human eye. However, as used herein, the term "non-torturous" is not meant to exclude a system of generally straight branched, channels. In one particular embodiment, the plurality of islands defines at least one branched channel. In another embodiment, the plurality of islands defines both branched and straight channels.

In one embodiment, the interface pad is disc-shaped and the plurality of islands includes concentric ridges underlying the abrasive article backing surface. In such an embodiment, at least some of the islands are generally ring-shaped and arranged concentrically. In some disc-shaped interface pads, the plurality of islands defines a plurality of concentric channels. For example, in one instance, the plurality of islands includes concentric ridges that define a plurality of concentric channels. A disc-shaped interface pad can also include a plurality of islands that also define at least one connection channel in fluid communication with at least two concentric channels. For example, a disc-shaped interface pad can include islands that define a generally radially extending channel in fluid communication with at least two concentric channels.

Channels defined by the plurality of islands can be symmetrically arranged about the interface pad. For example, a disc-shaped interface pad can include channels generally symmetric about the center of the pad. In other embodiments, the interface pad can include channels generally symmetric about one or more axes of symmetry. For example, a rectangular interface pad could include channels generally symmetric about at least a longitudinal axis of symmetry. Symmetry of the channels can be particularly important for interface pads that are intended to spin during use so as to prevent or minimize instability of the interface pad using use.

In one embodiment, at least one channel defined by the islands is positioned for alignment with at least one dust collection aperture defined by the support tool. For example, in one embodiment, the interface pad includes concentric channels and at least one concentric channel is radially positioned for alignment with dust collection apertures defined by the support tool.

The plurality of islands can include any of a variety of materials known in the art for use in abrasive article back up pads. In some embodiments, the islands include a polymer material such as, e.g., a polyurethane. For example, the islands can include a polymer foam such as, e.g., a polyurethane foam. The polymer foam can be closed cell or open cell polymer foam. In some embodiments, the islands include a rubber (natural or synthetic) or a rubber-like material. In addition, or alternatively, the plurality of islands can include at least one paper, wood, metal, or plastic material, or a combination thereof. In some instances, softer materials are preferred over more rigid materials. In some embodiments, both the abrasive article backing surface and the islands include the same material.

In some instances, the abrasive article backing surface and the plurality of islands are directly adjacent to one another. The abrasive article backing surface and the plurality of islands can be made to form an integral abrasive article backing surface/island structure such as by molding one or more materials to form an integral abrasive article backing surface/island structure. In some embodiments, the abrasive article backing surface and the plurality of islands are produced by machining one or more blanks of material.

The abrasive article backing surface and the plurality of islands can be separately formed and then adhered together. For example, the plurality of islands can be connected to the abrasive article backing surface with an adhesive. Many adhesives are known in the art and suitable for this application. In preferred embodiments, the adhesive is heat-resistant, shear resistant, or both. The adhesive should also be compatible with the materials used to form the islands or backing surfaces. Examples of suitable adhesives can include contact adhesives, acrylic adhesives such as cyanoacrylate adhesives, and epoxy adhesives.

In one embodiment, interface pad includes a channel-containing layer underlying the abrasive article backing surface wherein the layer includes a plurality of islands. The plurality of islands defines at least one channel. In some instances, the channel-containing layer can include a base upon which a plurality of islands are fixed. The channel-containing layer can be affixed to an abrasive article backing surface or can be integral with an abrasive article backing surface.

The interface pad also contains a support tool backing surface. "Support tool backing surface," as that phrase is used herein, refers to a backing surface to which a support tool can be fixed. The support tool backing surface can be, for example, a plain surface, a gripping surface, or an adhesive surface. The support tool backing surface can be adapted for affixation to a particular style of support tool. Thus, in one embodiment, a support tool includes a hook or loop fastener component and the support tool backing surface includes a compatible hook or loop fastener component. In another embodiment, the interface pad is intended to be mechanically secured to the support tool (e.g., via a fastener such as a central nut and bolt system) and the support tool backing surface includes a plain surface. In one embodiment, the support tool backing surface includes depressions or projections that correspond to depressions or projections, respectively, of the support tool to prevent movement or rotation of the interface pad relative to the support tool.

The support tool backing surface can include any of a variety of materials known in the art for use in abrasive article back up pads. In some embodiments, the support tool backing surface includes a polymer material such as, e.g., a polyurethane. For example, the support tool backing surface can include a polymer foam such as, e.g., a polyurethane foam. The polymer foam can be closed cell or open cell polymer foam. In some embodiments, the support tool backing surface includes a rubber (natural or synthetic) or a rubber-like material. In addition, or alternatively, the support tool backing surface can include at least one paper, wood, metal, or plastic material, or a combination thereof. In some instances, softer materials are preferred over more rigid materials. In some embodiments, both support tool backing surface and the islands include the same material. For instance, in some embodiments, the abrasive article backing surface, the islands, and the support tool backing surface include the same material.

In some instances, the support tool backing surface and the plurality of islands are directly adjacent to one another. The support tool backing surface and the plurality of islands can be made to form an integral support tool backing surface/island structure such as by molding one or more materials to form an integral support tool backing surface/island structure. In some embodiments, the support tool backing surface can be molded into a surface of at least one of the plurality of islands. For example, a hook or loop fastener component can be molded into a surface of at least one of the plurality of islands to form a support tool backing surface. Alternatively, a hook or loop fastener component can be laminated or adhered to a surface of at least one of the plurality of islands to form a support tool backing surface.

In some embodiments, the support tool backing surface and the plurality of islands are produced by machining one or more blanks of material. The support tool backing surface and the plurality of islands can be separately formed and then adhered together. For example, the plurality of islands can be connected to the support tool backing surface with an adhesive. Many adhesives are known in the art and suitable for this application. In preferred embodiments, the adhesive is heat-resistant, shear resistant, or both. The adhesive should also be compatible with the materials used to form the islands or backing surfaces. Examples of suitable adhesives can include contact adhesives, acrylic adhesives such as cyanoacrylate adhesives, and epoxy adhesives. In one embodiment, an abrasive article backing surface/island structure is formed and adhered to a support tool backing surface to form a interface pad. In another embodiment, a support tool backing surface/island structure is formed and adhered to an abrasive article backing surface to form a interface pad.

In one embodiment, the plurality of islands underlying the abrasive article backing surface can include an island underlying a perimeter of the abrasive article backing surface and the support tool backing surface underlies and is affixed to at least the island underlying the perimeter of the abrasive article backing surface.

The support tool backing surface can define an aperture and, in some embodiments, a plurality of apertures. In some instances, at least one aperture of the support tool backing surface is positioned for alignment with at least one aperture (e.g., dust collection aperture) defined by a support tool. The support tool backing surface can also contain a number of apertures of sufficient size and configured for alignment with at least a portion of apertures of just about any support tool.

The apertures defined by a support tool backing surface can be symmetrically arranged about the support tool backing surface. The backing surface can include apertures generally symmetric about one or more axes of symmetry. For example, a disc-shaped support tool backing surface can include apertures (e.g., circular, rectangular, triangular, ring-shaped, elongated, or arc-shaped apertures) that are generally radially symmetric. A rectangular backing surface could include apertures generally symmetric about, for example, a longitudinal axis of symmetry.

In one embodiment, the plurality of islands defines at least one channel in fluid communication with a plurality of the apertures defined by a support tool backing surface. The plurality of islands can also define a plurality of channels in fluid communication with each of the plurality of apertures in the support tool backing surface. In some instances, a plurality of apertures is in fluid communication via a single channel. For example, in some embodiments, 2, 3, 4, 5, or more apertures are in fluid communication via a single channel. Thus, at least one channel can be in fluid communication with more than two of the apertures defined by the support tool backing surface. In some embodiments, a majority or substantially all of the apertures defined by the support tool backing surface are in fluid communication with each other via at least one channel defined by the islands. In other embodiments, all of the apertures defined by the support tool backing surface are in fluid communication with each other via at least one channel defined by the islands.

The present invention also includes an interface pad for use between a perforated abrasive article and a support tool which includes: (a) an abrasive article backing surface defining a first plurality of apertures; (b) a first support structure underlying a perimeter of the abrasive article backing surface; (c) at least one additional support structure underlying the abrasive article backing surface, wherein the at least one additional support structure defines at least one channel in fluid communication with at least two of the first plurality of apertures; and (d) a support tool backing surface defining a second plurality of apertures, the support tool backing surface underlying and affixed to at least the first support structure, wherein the at least one channel is also in fluid communication with at least two of the second plurality of apertures.

Such an interface pad includes a first support structure underlying the perimeter of the abrasive article backing surface. The first support structure can include, for example, a ring-shaped structure such as an island or ridge underlying the perimeter of the abrasive article backing surface. In one embodiment, the abrasive article backing surface is disc-shaped and the first support structure underlying the abrasive article backing surface includes a generally ring-shaped structure underlying a perimeter (i.e., the circumference) of the disc-shaped abrasive article backing surface.

This interface pad also includes at least one additional support structure underlying the abrasive article backing surface. The at least one additional support structure can be selected, for example, from the group consisting of islands, peninsulas, and combinations thereof. The at least one additional support structure defines at least one channel in fluid communication with at least two of the first plurality of apertures.

The additional support structure can include at least one island. Island construction and configuration can be as described supra.

The additional support structure can include at least one peninsula underlying the abrasive article backing surface and extending generally from the first support structure toward a center of the interface pad. The peninsula can be directly adjacent to the first support structure, can be integral with the first support structure, can be directly adjacent to another support structure, or can be integral with another support structure. Peninsulas can be constructed and configured similarly to islands, described supra.

The support structures (e.g., the first support structure and at least one additional support structure) can be symmetrically arranged about the interface pad. For example, a disc-shaped interface pad can include support structures generally symmetric about the center of the pad. In other embodiments, the interface pad can include support structures generally symmetric about one or more axes of symmetry. For example, a rectangular interface pad could include support structures generally symmetric about at least a longitudinal axis of symmetry. In one embodiment, the at least one additional support structure includes a plurality of additional support structures symmetrically positioned with respect to each other.

The at least one additional support structure defines (at least partially) at least one channel in fluid communication with at least two of the first plurality of apertures and with at least two of the second plurality of apertures. Preferably, the apertures and the channels are configured such that swarf produced during an abrasion process can be effectively transported through the abrasive article backing surface's apertures, through the channels, and through the support tool backing surface's apertures to reach a support tool's dust extraction system.

In one embodiment, the support structures (e.g., the first support structure and at least one additional support structure) define a plurality of channels in fluid communication with each of the first plurality of apertures and with each of the second plurality of apertures. The channels can be interconnected or not interconnected. Thus, in some embodiments, support structures also define at least one connection channel in fluid communication with at least two other channels. In some instances, one or more of the first or second plurality of apertures are in fluid communication via a single channel. For example, in some embodiments, 2, 3, 4, 5, or more apertures are in fluid communication via a single channel. Thus, at least one channel can be in fluid communication with more than two apertures of the first plurality of apertures, with more than two apertures of the second plurality of apertures, or with more than two apertures of the first and second plurality of apertures. In one embodiment, all of the first plurality of apertures and the second plurality of apertures are in fluid communication with each other via at least one channel defined by the support structures.

Preferably, at least one channel is non-torturous. For example, at least one channel is generally straight and does not have significant twists, turns, or bends. In one embodiment, at least one channel is non-torturous and the channel does not contain twists, turns, or bends unobservable to the unaided human eye. However, as used herein, the term "non-torturous" is not meant to exclude a system of generally straight branched, channels. In one particular embodiment, the support structures define at least one branched channel. In another embodiment, the support structures define both branched and straight channels.

Channels defined by the support structures can be symmetrically arranged about the interface pad. For example, a disc-shaped interface pad can include channels generally symmetric about the center of the pad. In other embodiments, the interface pad can include channels generally symmetric about one or more axes of symmetry. For example, a rectangular interface pad could include channels generally symmetric about at least a longitudinal axis of symmetry.

In another embodiment, an interface pad for use between a perforated abrasive article and a support tool can include: (a) an abrasive article backing surface defining a plurality of apertures; (b) a channel-containing layer underlying the abrasive article backing surface, the channel-containing layer defining at least one channel in fluid communication with at least two of the plurality of apertures; and (c) a support tool backing surface underlying the channel-containing layer.

This embodiment includes a channel-containing layer underlying the abrasive article backing surface. The channel-containing layer defines at least one channel in fluid communication with at least two of the plurality of apertures in the abrasive article backing surface. Preferably, the apertures in the abrasive article backing surface and the at least one channel are configured such that swarf produced during an abrasion process can be effectively transported through the abrasive article backing surface's apertures and through the channel to reach a support tool's dust extraction system.

The channel-containing layer can include one or more islands, described more fully supra. For example, the channel-containing layer can include an island underlying a perimeter of the abrasive article backing surface. In one instance, the abrasive article backing surface is disc-shaped and the channel-containing layer includes a generally ring-shaped island underlying a perimeter (i.e., the circumference) of the disc-shaped abrasive article backing surface. An island underlying a perimeter of the abrasive article backing surface can include at least one peninsula underlying the abrasive article backing surface and extending generally from a perimeter of the interface pad toward a center of the interface pad. In some embodiments, one or more peninsulas in the channel-containing layer define channels in fluid communication with at least two of the plurality of apertures of the abrasive article backing surface.

In one embodiment, the channel-containing layer defines a plurality of channels in fluid communication with each of the plurality of apertures in the abrasive article backing surface. The channels can be interconnected or not interconnected. Thus, in some embodiments, the channel-containing layer also define at least one connection channel in fluid communication with at least two other channels. In some instances, a plurality of apertures is in fluid communication via a single channel. For example, in some embodiments, 2, 3, 4, 5, or more apertures are in fluid communication via a single channel. Thus, at least one channel can be in fluid communication with more than two of the apertures defined by the abrasive article backing surface. In some embodiments, a majority or substantially all of the apertures defined by the abrasive article backing surface are in fluid communication with each other via at least one channel defined by the channel-containing layer. In other embodiments, all of the apertures defined by the abrasive article backing surface are in fluid communication with each other via at least one channel defined by the channel-containing layer.

Preferably, at least one channel is non-torturous. For example, at least one channel is generally straight and does not have significant twists, turns, or bends. In one embodiment, at least one channel is non-torturous and the channel does not contain twists, turns, or bends unobservable to the unaided human eye. However, as used herein, the term "non-torturous" is not meant to exclude a system of generally straight branched, channels. In one particular embodiment, the channel-containing layer defines at least one branched channel. In another embodiment, the channel-containing layer defines both branched and straight channels.

In one embodiment, the interface pad is disc-shaped and the channel-containing layer includes concentric islands or ridges underlying the abrasive article backing surface. In such an embodiment, at least some of the islands or ridges are generally ring-shaped and arranged concentrically. In some disc-shaped interface pads, the channel-containing layer defines a plurality of concentric channels. For example, in one instance, the channel-containing layer includes concentric ridges that define a plurality of concentric channels. A disc-shaped interface pad can also include a channel-containing layer that also defines at least one connection channel in fluid communication with at least two concentric channels. For example, a disc-shaped interface pad can include a channel-containing layer that defines a generally radially extending channel in fluid communication with at least two concentric channels.

Channels defined by the channel-containing layer can be symmetrically arranged about the interface pad. For example, a disc-shaped interface pad can include channels generally symmetric about the center of the pad. In other embodiments, the interface pad can include channels generally symmetric about one or more axes of symmetry. For example, a rectangular interface pad could include channels generally symmetric about at least a longitudinal axis of symmetry.

In one embodiment, at least one channel defined by the channel-containing layer is positioned for alignment with at least one dust collection aperture defined by the support tool. For example, in one embodiment, the channel-containing layer includes concentric channels and at least one concentric channel is radially positioned for alignment with at dust collection apertures defined by the support tool.

The channel-containing layer can include any of a variety of materials known in the art for use in abrasive article back up pads. In some embodiments, the channel-containing layer includes a polymer material such as, e.g., a polyurethane. For example, the channel-containing layer can include a polymer foam such as, e.g., a polyurethane foam. The polymer foam can be closed cell or open cell polymer foam. In some embodiments, the channel-containing layer includes a rubber (natural or synthetic) or a rubber-like material. In addition, or alternatively, the channel-containing layer can include at least one paper, wood, metal, or plastic material, or a combination thereof. In some instances, softer materials are preferred over more rigid materials. In some embodiments, both the abrasive article backing surface and the channel-containing layer include the same material.

In some instances, the channel-containing layer can include a base upon which a channel-defining structure or structures are fixed. For example, the channel-containing layer can be machined to produce channels in a blank of material.

Alternatively, the channel-containing layer can be produced by forming channel-defining structures on a base or other substrate such as, for example, the abrasive article backing surface or the support tool backing surface.

In some instances, the abrasive article backing surface and the channel-containing layer are directly adjacent to one another. The abrasive article backing surface and the channel-containing layer can be made to form an integral abrasive article backing surface/channel-containing layer structure such as by molding one or more materials to form an integral abrasive article backing surface/channel-containing layer structure. In some embodiments, the abrasive article backing surface and the channel-containing layer are produced by machining one or more blanks of material.

The abrasive article backing surface and the channel-containing layer can be separately formed and then adhered together. For example, the channel-containing layer can be connected to the abrasive article backing surface with an adhesive. Many adhesives are known in the art and suitable for this application. In preferred embodiments, the adhesive is heat-resistant, shear resistant, or both. The adhesive should also be compatible with the materials used to form the channel-containing layer or the backing surfaces. Examples of suitable adhesives can include contact adhesives, acrylic adhesives such as cyanoacrylate adhesives, and epoxy adhesives.

In some instances, the support tool backing surface and the channel-containing layer are directly adjacent to one another. The support tool backing surface and the channel-containing layer can be made to form an integral support tool backing surface/channel-containing layer structure such as by molding one or more materials to form an integral support tool backing surface/channel-containing layer structure. In some embodiments, the support tool backing surface and the channel-containing layer are produced by machining one or more blanks of material.

The support tool backing surface and the channel-containing layer can be separately formed and then adhered together. For example, the channel-containing layer can be connected to the support tool backing surface with an adhesive. Many adhesives are known in the art and suitable for this application. In preferred embodiments, the adhesive is heat-resistant, shear resistant, or both. The adhesive should also be compatible with the materials used to form the channel-containing layer or the backing surfaces. Examples of suitable adhesives can include contact adhesives, acrylic adhesives such as cyanoacrylate adhesives, and epoxy adhesives.

In one embodiment, the support tool backing surface underlying the channel-containing layer defines a plurality of apertures. Suitable support tool backing surfaces defining a plurality of apertures are described supra.

In some embodiments, the channel-containing layer defines at least one channel in fluid communication with a plurality of the apertures defined by the support tool backing surface. The channel-containing layer can also define a plurality of channels in fluid communication with each of the plurality of apertures in the support tool backing surface. In some instances, a plurality of apertures is in fluid communication via a single channel. For example, in some embodiments, 2, 3, 4, 5, or more apertures are in fluid communication via a single channel. Thus, at least one channel can be in fluid communication with more than two of the apertures defined by the support tool backing surface. In some embodiments, a majority or substantially all of the apertures defined by the support tool backing surface are in fluid communication with each other via at least one channel defined by the channel-containing layer. In other embodiments, all of the apertures defined by the support tool backing surface are in fluid communication with each other via at least one channel defined by the channel-containing layer.

In general, the shape of the interface pads described herein can be chosen for compatibility with the shape of the support tool or the abrasive article. For example, the interface pad can be approximately the same size or shape as that of the abrasive article or support tool. In some embodiments, the interface pad can be disc-shaped, three-sided, quadrilateral, five-sided, iron-shaped, or leaf-shaped, among others. Three-sided interface pads can have straight, arced, or irregular sides. Quadrilateral interface pads can be, for example, rectangular, square, or rhombic, with straight, arced, or irregular sides. Five-sided interface pads can have straight, arced, or irregular sides. Iron-shaped interface pads can include five-sided polygons wherein at least two adjacent sides arc toward one another. In some instances, a iron-shaped interface pad is shaped like the base of a steam iron for garments. Leaf-shaped interface pads include those generally symmetric lengthwise and having two arcs connected on two sides. Other shapes can be chosen by one of ordinary skill in the art without departing from the scope of the invention disclosed herein.

In some embodiments, the apertures and channels of the interface pad are configured such that there no need to orient the interface pad in any particular manner between the abrasive article and the support tool. This configuration can be achieved by supplying a sufficient number of apertures of sufficient size in the abrasive article backing surface and in the support tool backing surface and by connecting a sufficient number of the apertures with channels. One of ordinary skill in the art can readily select a configuration of interface pad apertures and channels for use with a variety of abrasive articles and support tools. In a preferred embodiment, the apertures of the interface pad are configured such that for each aperture, several other interface pad apertures are in close proximity.

For effective functioning it is not strictly necessary that there be a 100% alignment between the apertures in the abrasive article and support tool and apertures in the interface pad but there should be sufficient alignment to allow a dust exhaust system to function effectively. Approximately 100% alignment is preferred but efficient functioning could be achieved with much less overlap although this is less preferred.

The present invention also includes an abrasive tool, comprising: (a) a perforated abrasive article defining a first plurality of apertures; (b) an interface pad as described herein which includes an abrasive article backing surface that defines a second plurality of apertures; and (c) a support tool defining a third plurality of apertures; wherein the interface pad is positionable between the perforated abrasive article and the support tool.

In some embodiments, the perforated abrasive article is a perforated coated abrasive wherein the abrasive article can have first and second major surfaces. The first major surface can include an abrasive coating such as, for example, abrasive particles and a binder by which the particles are adhered to the surface. The particles and binders can be selected from any of those known in the art and the configurations on the surface can be provided in any known way. The second major surface generally includes a component for attaching the abrasive article to the interface pad such as, for example, an adhesive or a hook or loop fastener component. However, in some instances the second major surface does not include such a component for attaching the abrasive article.

In one embodiment, the interface pad includes (i) an abrasive article backing surface defining a second plurality of apertures; (ii) a plurality of islands underlying the abrasive article backing surface, the islands defining at least one channel in fluid communication with at least two of the second plurality of apertures; and (iii) a support tool backing surface underlying the plurality of islands.

In another embodiment, the interface pad includes (i) an abrasive article backing surface defining a second plurality of apertures; (ii) a channel-containing layer underlying the abrasive article backing surface, the channel-containing layer defining at least one channel in fluid communication with at least two of the second plurality of apertures; and (iii) a support tool backing surface underlying the channel-containing layer.

In various embodiments of the abrasive tool, the perforated abrasive article, the abrasive article backing surface, the support tool backing surface, or the support tool include a hook or loop fastener component. In some embodiments, the perforated abrasive article, the abrasive article backing surface, the support tool backing surface, and the support tool each include a hook or loop fastener component.

The support tool can include generally any type of abrasive sander or machine. For example, the support tool can include an orbital, rotating, or vibratory machine.

In some embodiments, the support tool includes at least one dust collection aperture that is in communication with a dust collection system. For example, in some embodiments, the support tool includes a third plurality of dust collection apertures. In one embodiment of the abrasive tool, the first plurality of apertures is not directly alignable with the third plurality of apertures when the perforated abrasive article and the support tool are brought together. For example, the first plurality of apertures can differ from the third plurality of apertures in a manner selected from the group consisting of size, shape, orientation, position, or combinations thereof. Thus, when the interface pad is positioned between the perforated abrasive article and the support tool, at least two of the first plurality of apertures are at least partially aligned with at least two of the second plurality of apertures.

The interface pads can provide a functional interface between the abrasive article and the support tool by permitting the flow of dust away from the work surface, through the channel(s) of the interface pad, and into the dust collection system provided by the support tool. The interface pads described herein contain apertures and at least one channel configured such that an interface pad can be used between an abrasive article having a particular configuration of apertures and a support tool having a different configuration of dust collection apertures.

For effective functioning of the abrasive tool it is not strictly necessary that there be a 100% alignment between the apertures in the abrasive article and support tool and apertures in the interface pad but there should be sufficient alignment to allow a dust exhaust system to function effectively. Approximately 100% alignment is preferred but efficient functioning could be achieved with much less overlap although this is less preferred.

FIGS. 1 to 12B are drawings of various example embodiments of the present invention. In some embodiments, surfaces labeled in the description of the Figures as either "abrasive support backing surface" and "support tool backing surface" are interchangeable.

FIG. 1 is a perspective view of an interface pad according to one embodiment of the present invention. Interface pad 100 includes concentric islands 102 underlying abrasive article backing surface 104 which includes apertures 106. Concentric islands 102 define concentric channels 108. Concentric channels 108 are in fluid communication with a portion of the apertures 106. Interface pad 100 also includes central hole 110 which can be used to mount the interface pad over a support tool spindle. In one embodiment, concentric islands 102 also include support tool backing surface 112 underlying the islands.

Figure 2A:
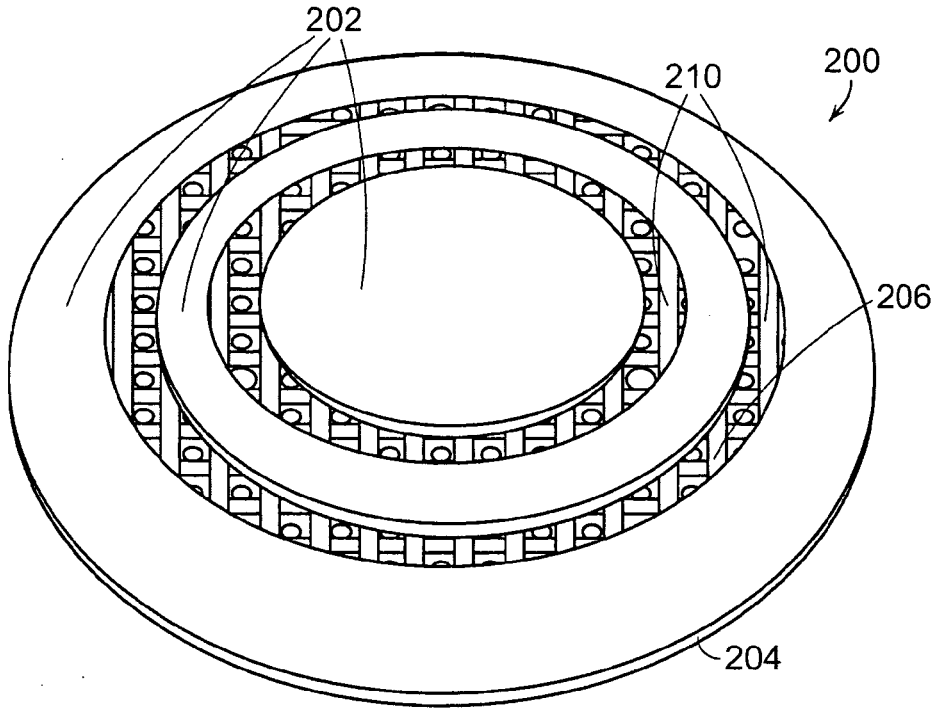
FIGS. 2A and 2B are perspective views of an interface pad according to one embodiment of the present invention.
Figure 2B:
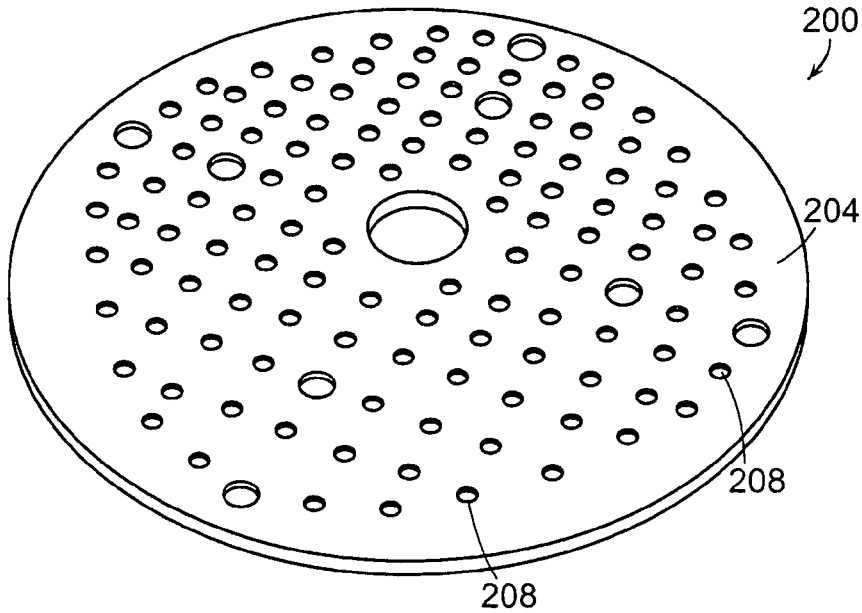
Figure 3B:
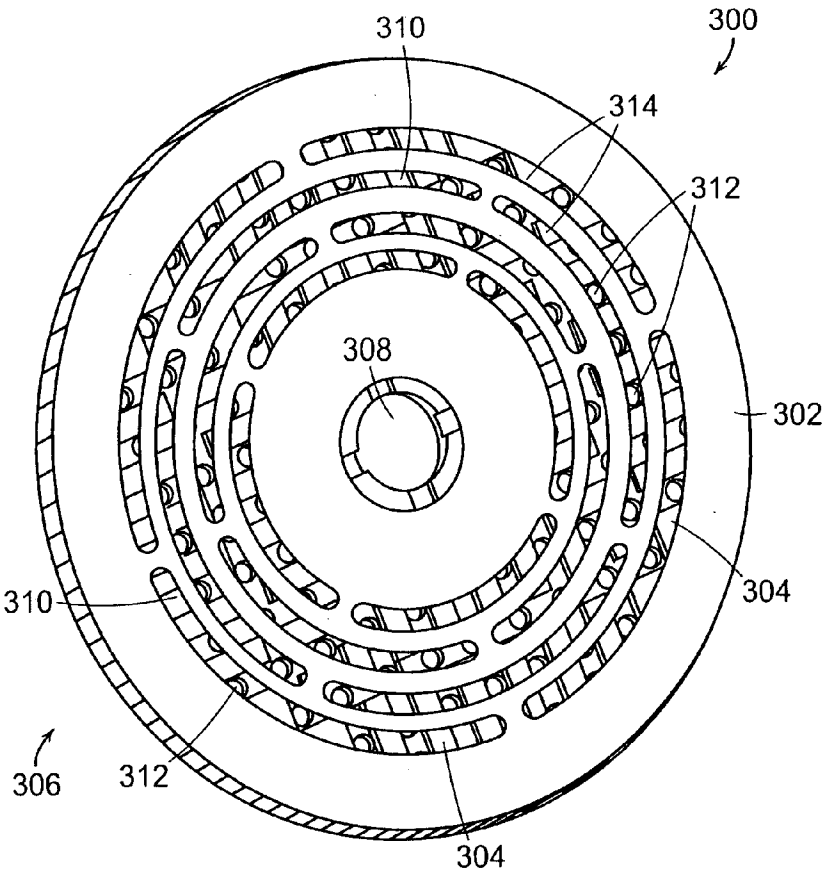
FIGS. 3A-3D are views of an interface pad according to one embodiment of the present invention wherein the support tool backing surface includes arc-shaped apertures.
Figure 3A:
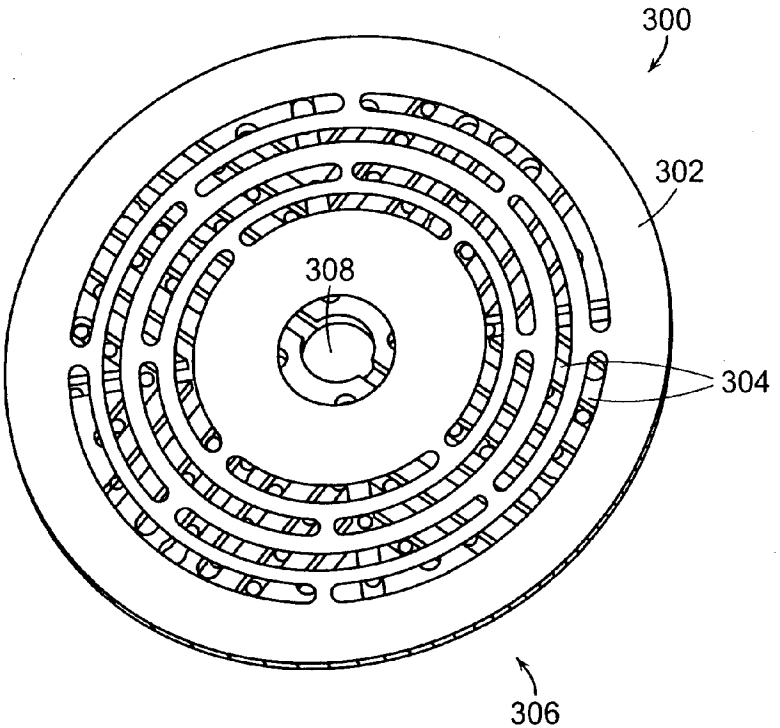
Figure 3D:
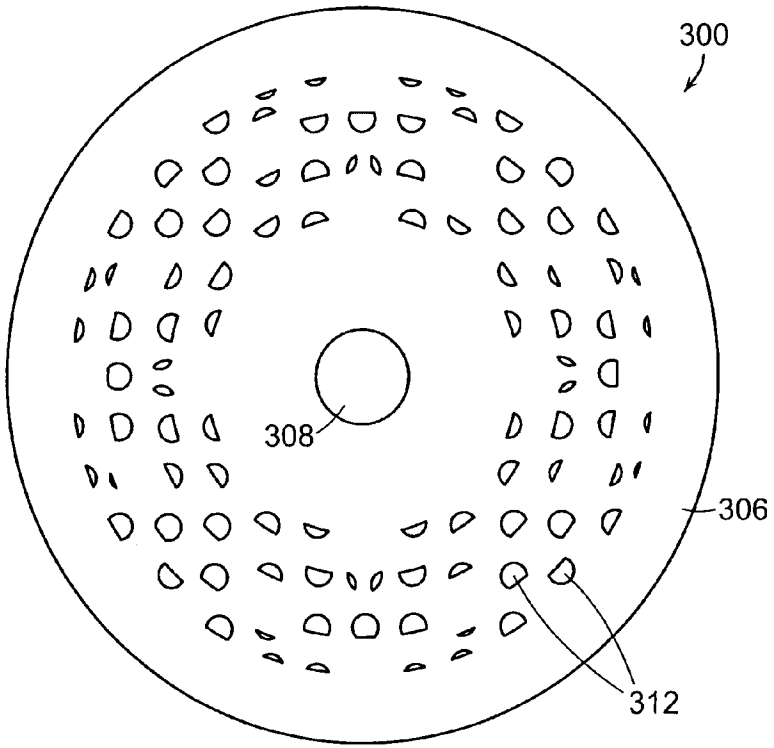
Figure 3C:
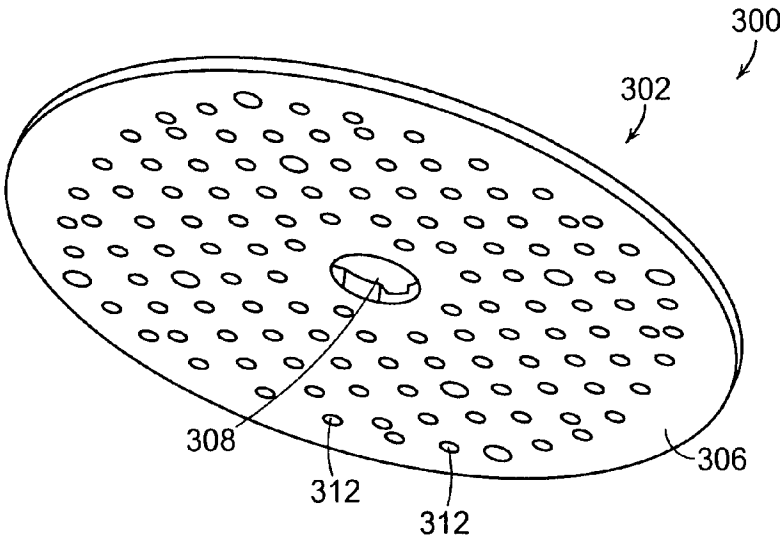
Figure 4A:
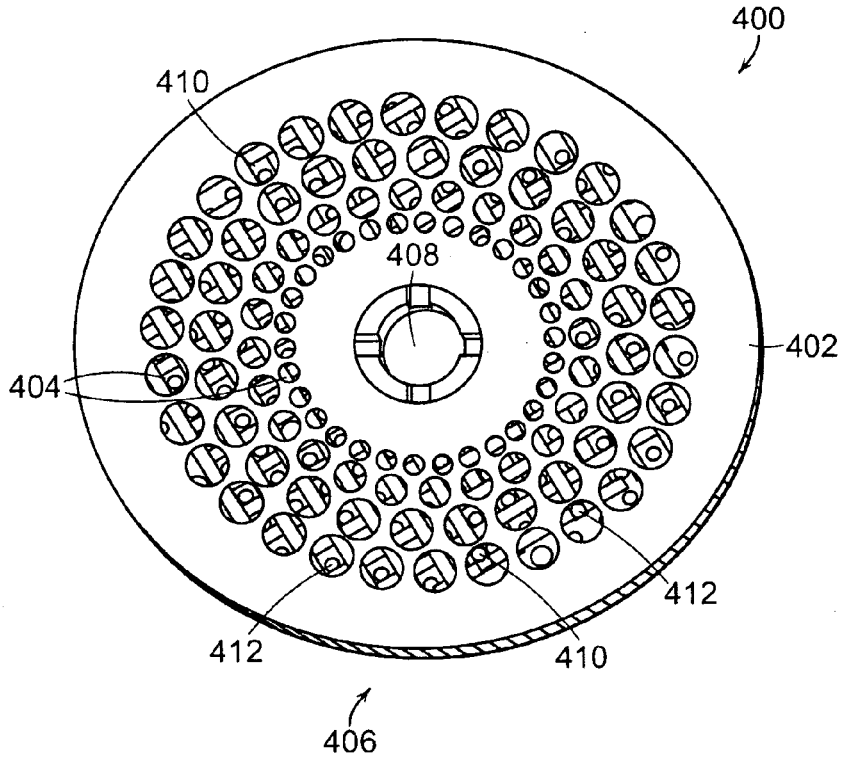
FIGS. 4A-4D are views of an interface pad according to another embodiment of the present invention.
Figure 4B:
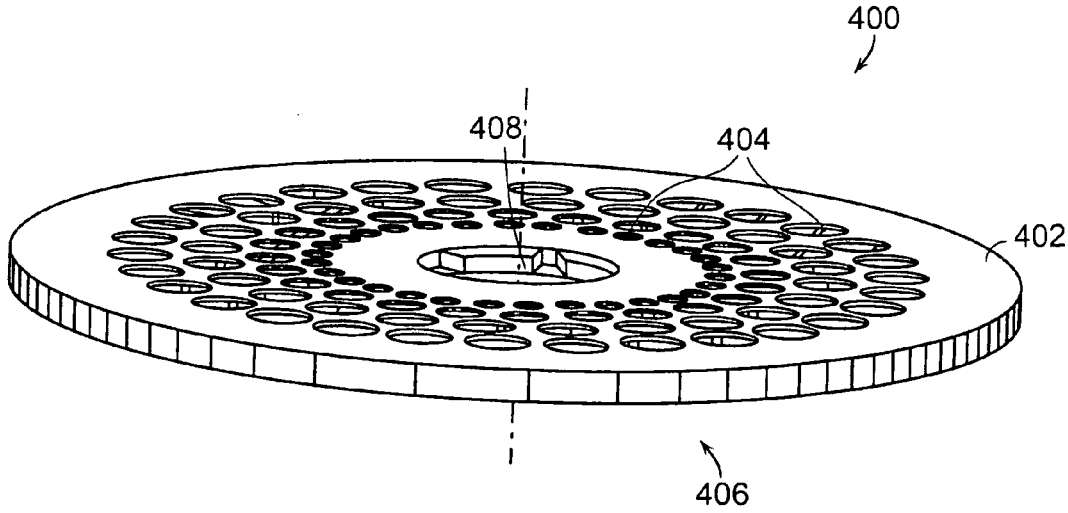
Figure 4C:
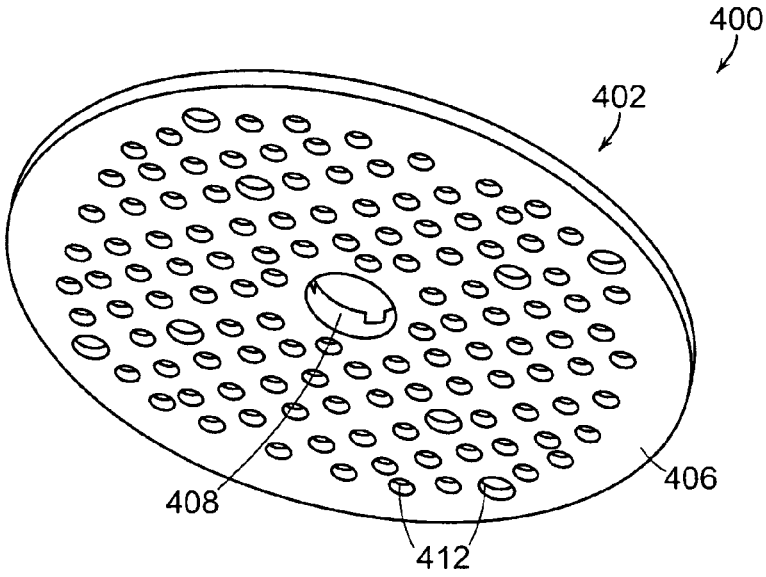
Figure 4D:
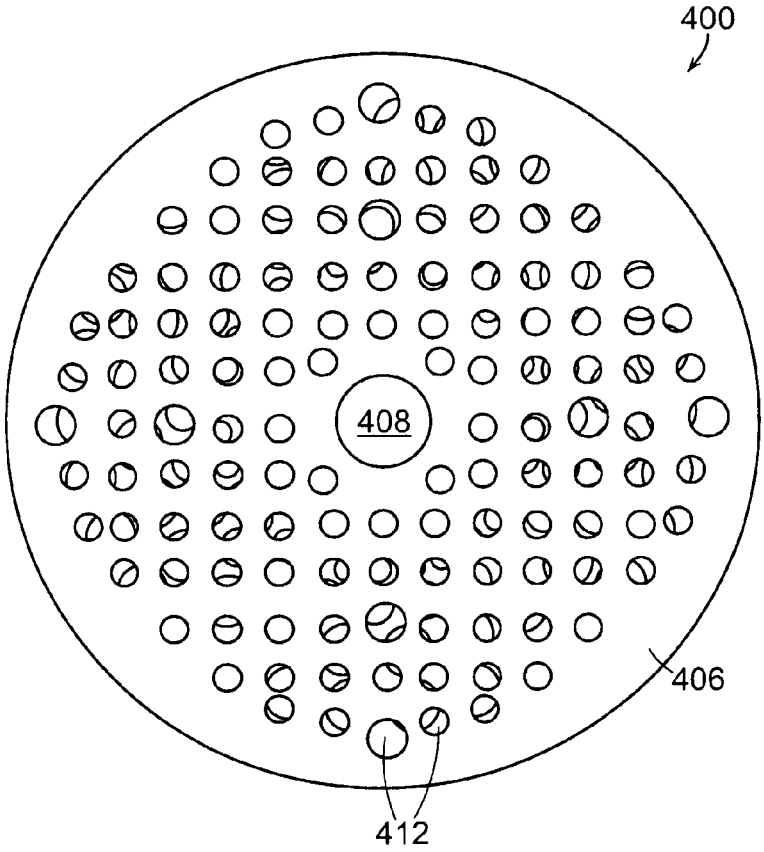
Figure 5A:
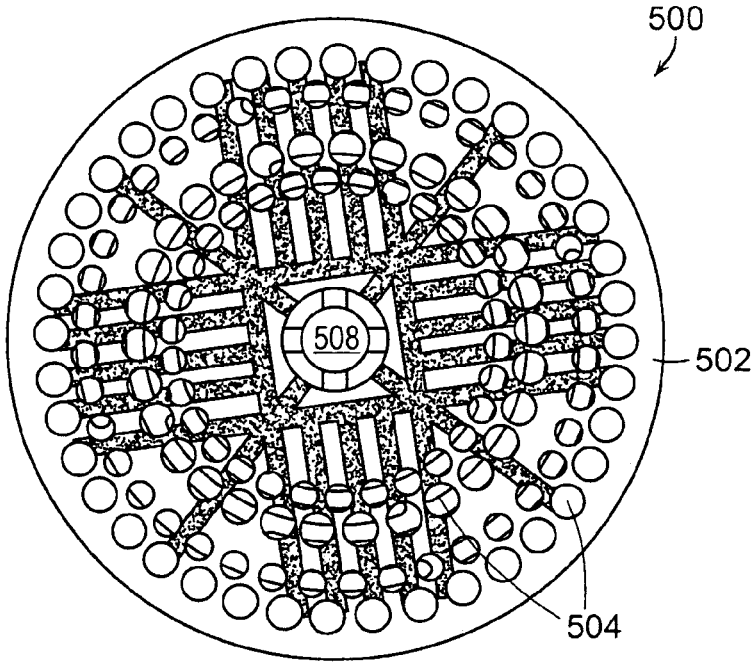
FIGS. 5A-5D are views of an interface pad according to another embodiment of the present invention.
Figure 5B:
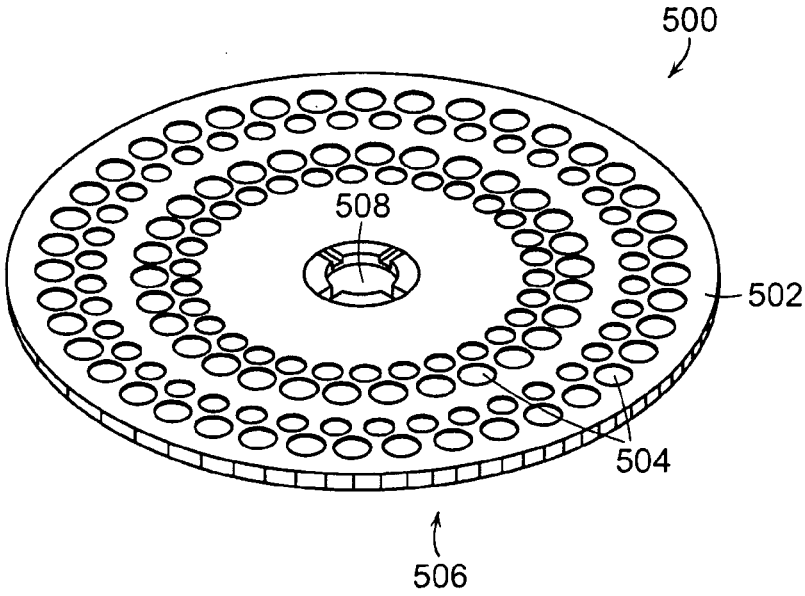
Figure 5C:
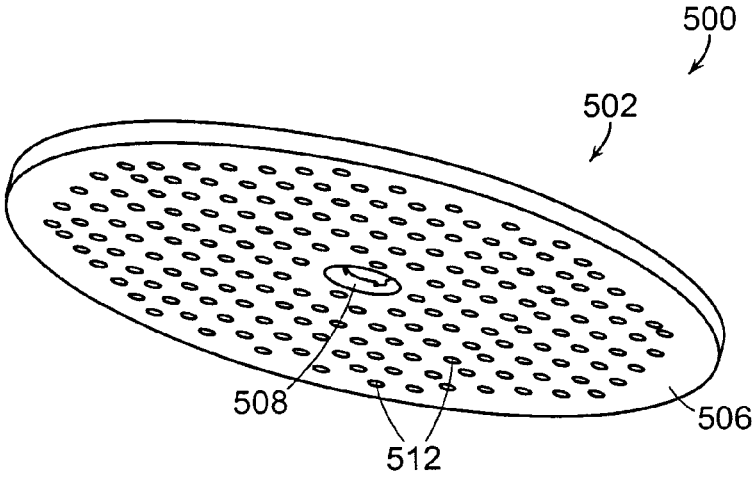
Figure 5D:
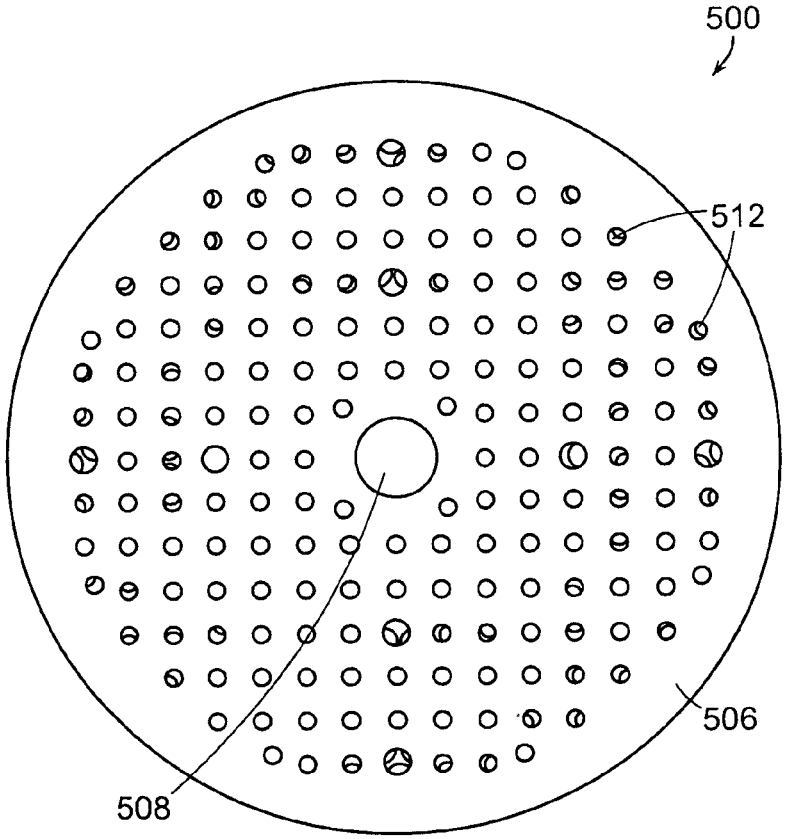

FIGS. 2A and 2B are perspective views of an interface pad according to one embodiment of the present invention. Interface pad 200 includes support tool backing surface 202 and abrasive article backing surface 204. Between support tool backing surface 202 and abrasive article backing surface 204 is channel-containing layer 206. Channel-containing layer 206 includes channels in fluid communication with apertures 208 defined by abrasive article backing surface 204. Support tool backing surface 202 includes apertures 210.

FIGS. 3A-3D are views of an interface pad according to one embodiment of the present invention. Interface pad 300 includes support tool backing surface 302 which defines arc-shaped apertures 304. Interface pad 300 also includes abrasive article backing surface 306 and central hole 308. Between support tool backing surface 302 and abrasive article backing surface 306 is channel-containing layer 314. Channel-containing layer 314 includes channels 310 in fluid communication with arc-shaped apertures 304 defined by support tool backing surface 302 and apertures 312 defined by abrasive article backing surface 304.

FIGS. 4A-4D are views of an interface pad according to one embodiment of the present invention. Interface pad 400 includes support tool backing surface 402 which defines apertures 404 of various sizes. Interface pad 400 also includes abrasive article backing surface 406 and central hole 408. Between support tool backing surface 402 and abrasive article backing surface 406 is a channel-containing layer. The channel-containing layer includes channels 410 in fluid communication with apertures 404 defined by support tool backing surface 402 and apertures 412 defined by abrasive article backing surface 404.

FIGS. 5A-5D are views of an interface pad according to one embodiment of the present invention. Interface pad 500 includes support tool backing surface 502 which defines apertures 504. Interface pad 500 also includes abrasive article backing surface 506 and central hole 508. Between support tool backing surface 502 and abrasive article backing surface 506 is a channel-containing layer. The channel-containing layer includes channels in fluid communication with apertures 504 defined by support tool backing surface 502 and apertures 512 defined by abrasive article backing surface 504.

Figure 6A:
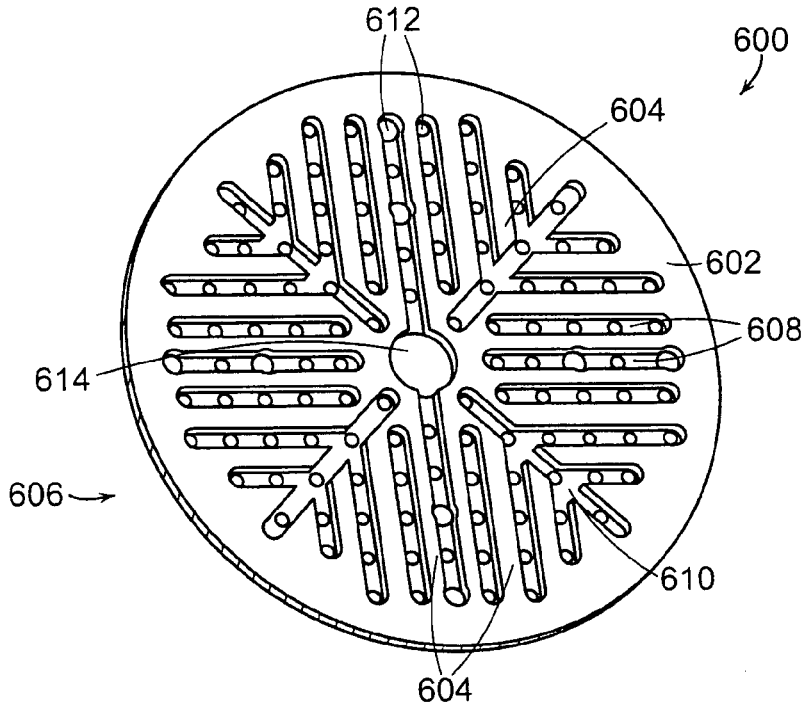
FIGS. 6A-6C are section views of a portion of an interface pad according to one embodiment.
Figure 6B:
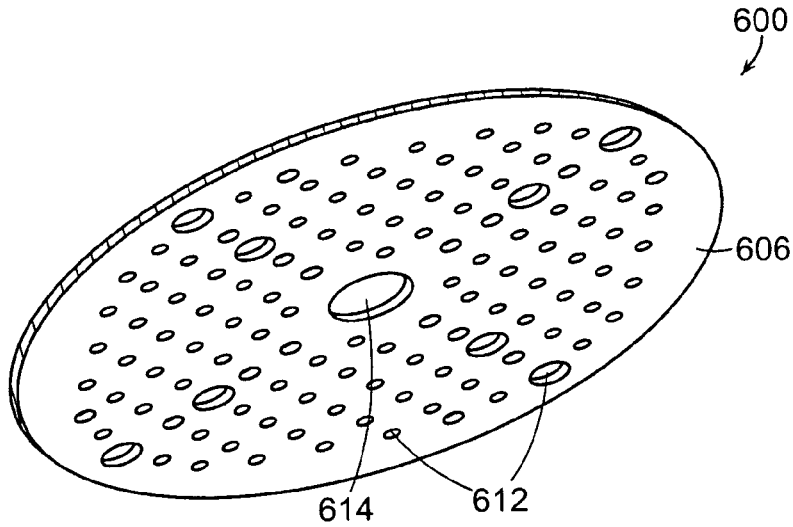
Figure 6C:
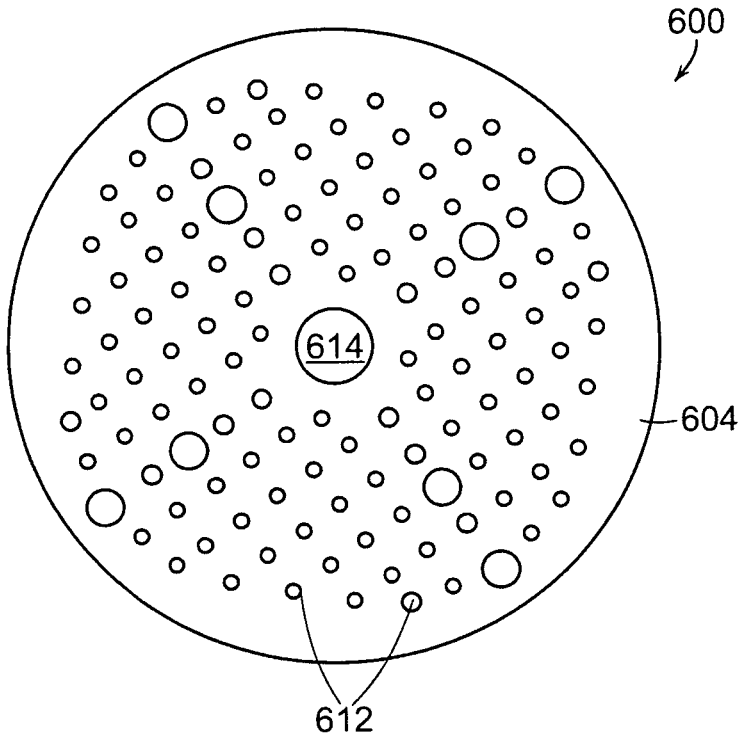
Figure 7A:
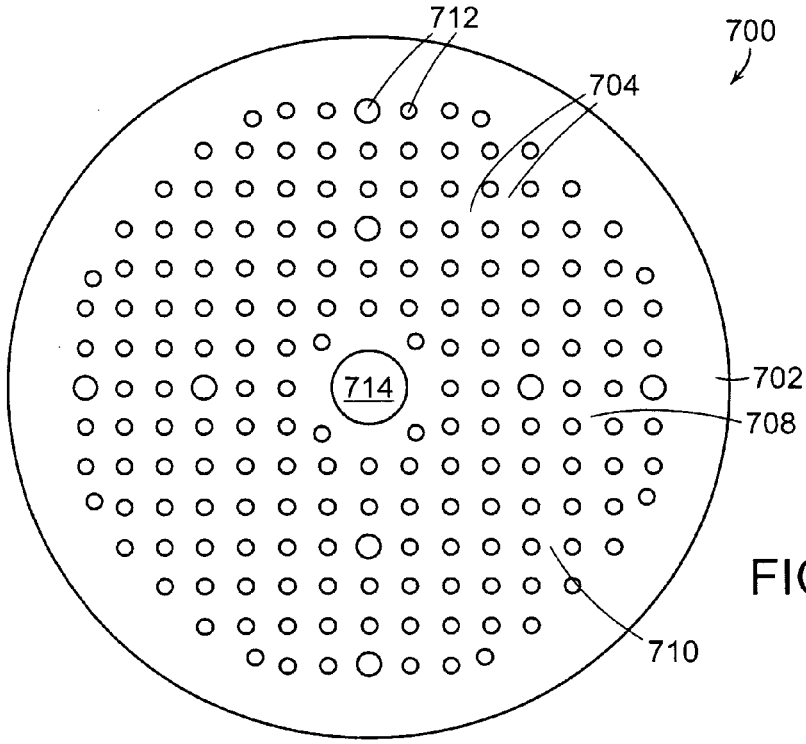
FIGS. 7A-7D are section views of a portion of an interface pad according to another embodiment.
Figure 7B:
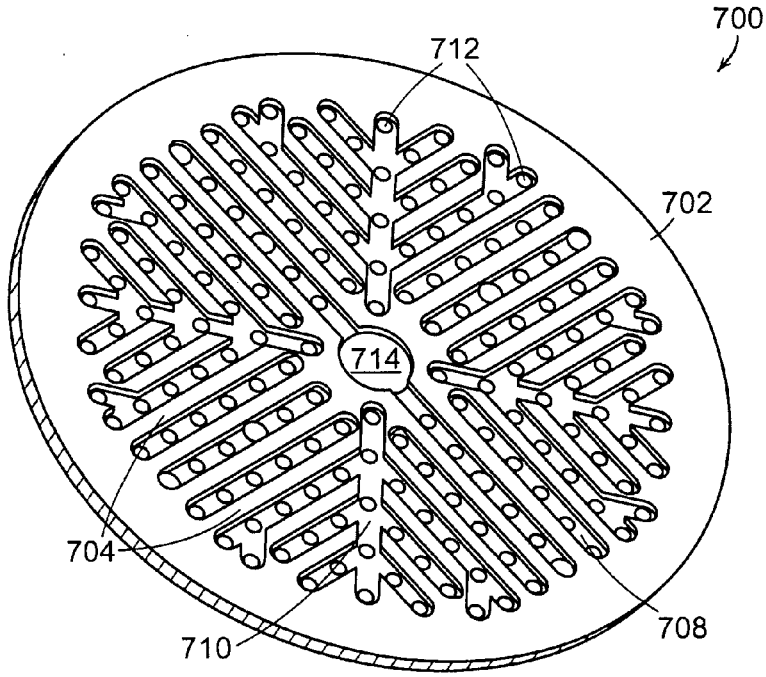
Figure 7C:
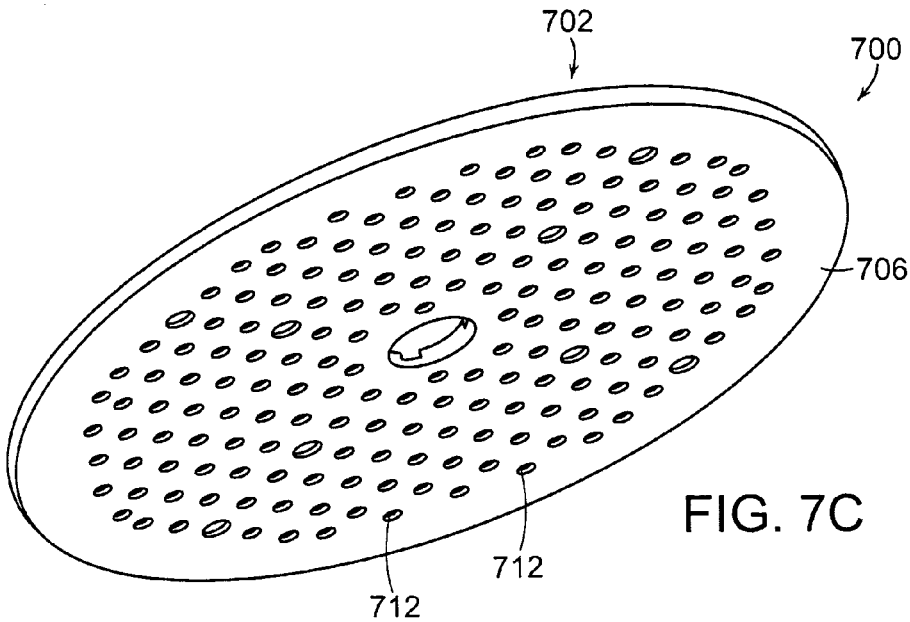
Figure 7D:
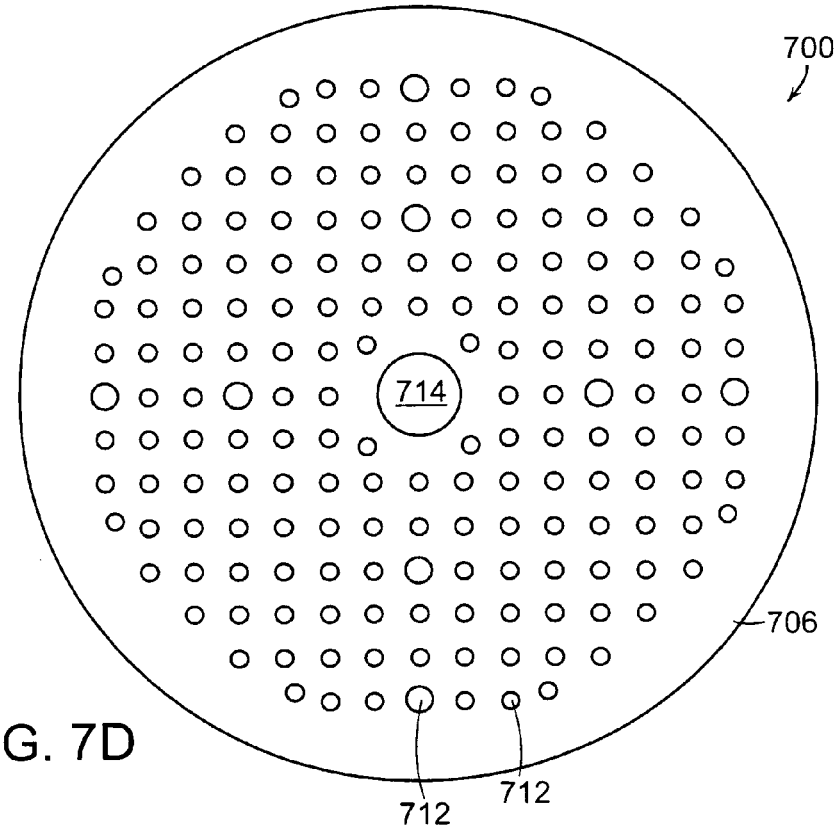

FIGS. 6A-6C are section views of an interface pad according to one embodiment of the present invention. Sectioned interface pad 600 includes channel-containing layer 602 which includes support structures 604. Sectioned interface pad 600 also includes abrasive article backing surface 606. Channel-containing layer 602 includes straight channels 608 and branched channels 610. Abrasive article backing surface 606 includes apertures 612 in fluid communication with channels 608 and 610. Sectioned interface pad 600 also includes central hole 614.

FIGS. 7A-7D are sectional views of an interface pad according to one embodiment of the present invention. Sectioned interface pad 700 includes channel-containing layer 702 which includes support structures 704. Sectioned interface pad 700 also includes abrasive article backing surface 706. Channel-containing layer 702 includes straight channels 708 and branched channels 710. Abrasive article backing surface 706 includes apertures 712 in fluid communication with channels 708 and 710. Sectioned interface pad 700 also includes central hole 714.

Figure 8:
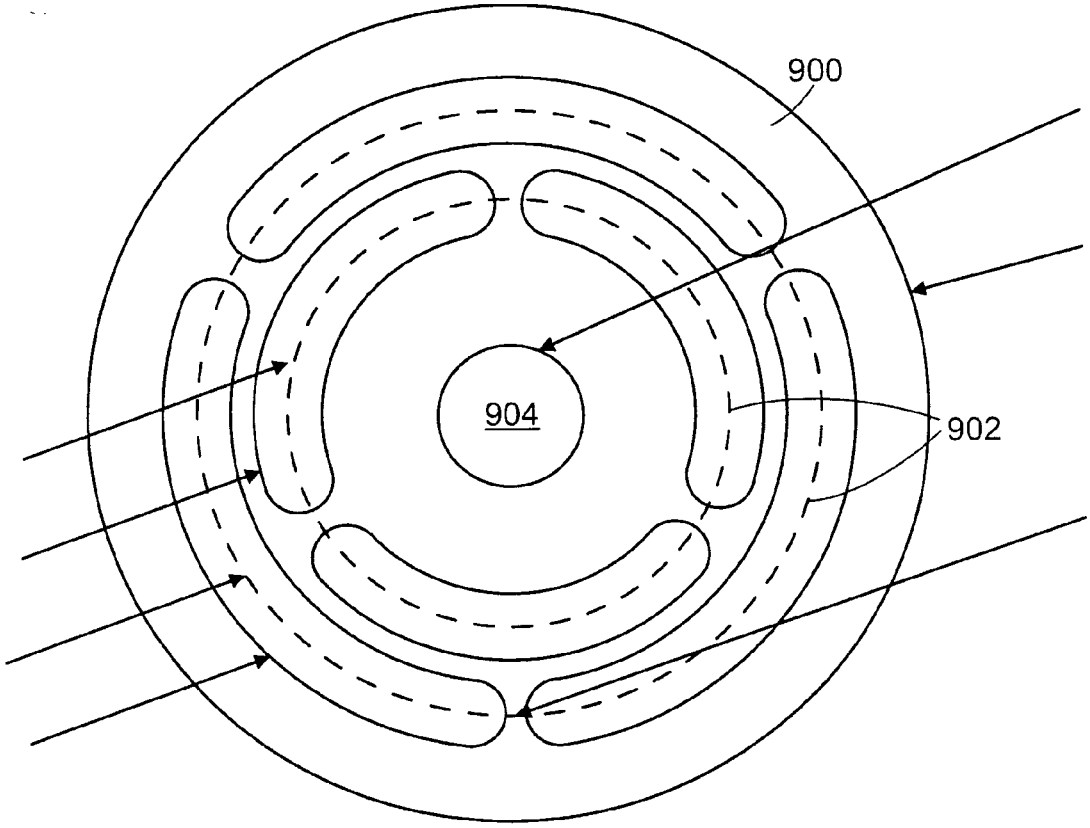
FIG. 8 is a view of an interface pad according to one embodiment of the present invention wherein the support tool backing surface includes arc-shaped apertures.

FIG. 8 is a view of a support tool backing surface according to one embodiment of the present invention. Support tool backing surface 900 defines arc-shaped apertures 902 and central hole 904.

Figure 9A:
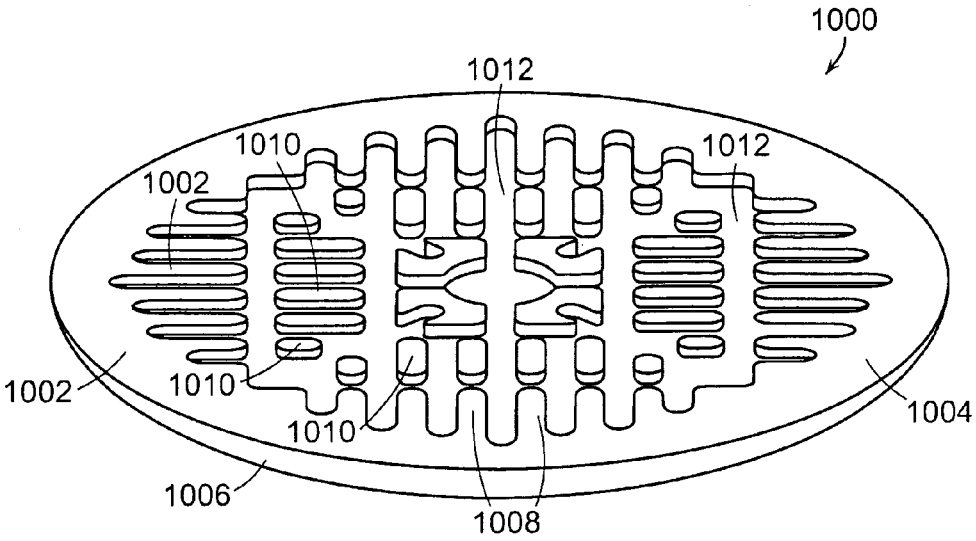
FIGS. 9A and 9B are sectional views of a partially constructed interface pad according to one embodiment of the present invention.
Figure 9B:
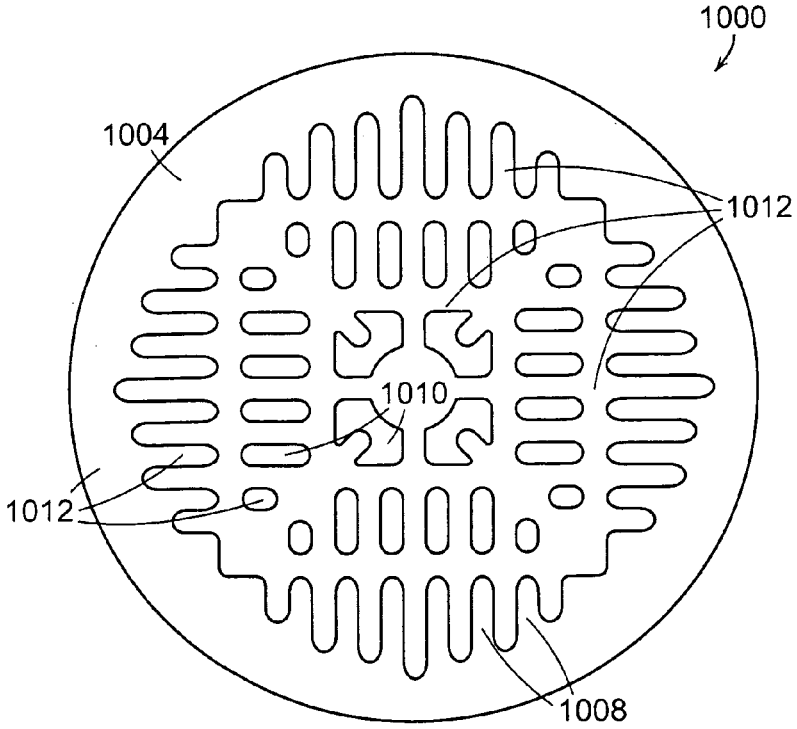

FIGS. 9A and 9B are sectional views of a partially constructed interface pad according to one embodiment of the present invention. Sectioned interface pad 1000 includes channel-containing layer 1002. Channel-containing layer 1002 includes ring-shaped island 1004 underlying a perimeter (i.e., the circumference) of abrasive article backing surface 1006 and peninsulas 1008 and islands 1010. Channel-containing layer 1002 includes channels 1012 defined by ring-shaped island 1004, peninsulas 1008, and islands 1010.

Figure 10:
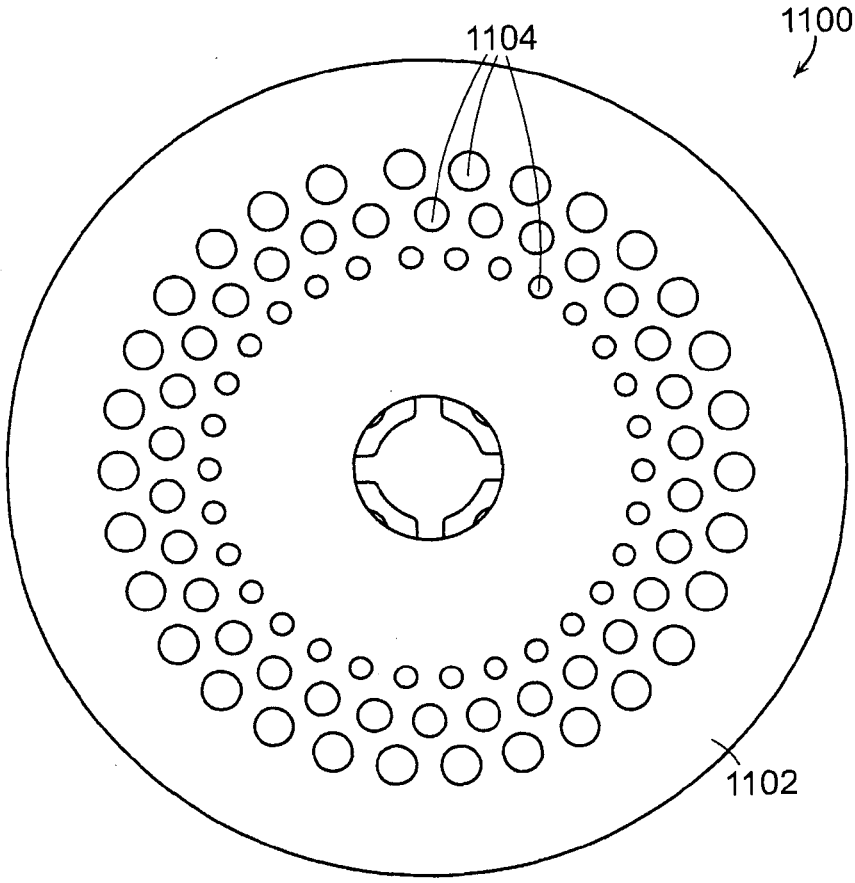
FIG. 10 is another partially constructed interface pad which includes the partially constructed interface pad of FIGS. 9A and 9B according to one embodiment of the present invention.

FIG. 10 is another partially constructed interface pad which includes the partially constructed interface pad of FIGS. 9A and 9B according to one embodiment of the present invention. Partially constructed interface pad 1100 includes support tool backing surface 1102. Support tool backing surface 1102 includes a loop fastener component. Support tool backing surface 1102 defines apertures 1104.

Figure 11A:
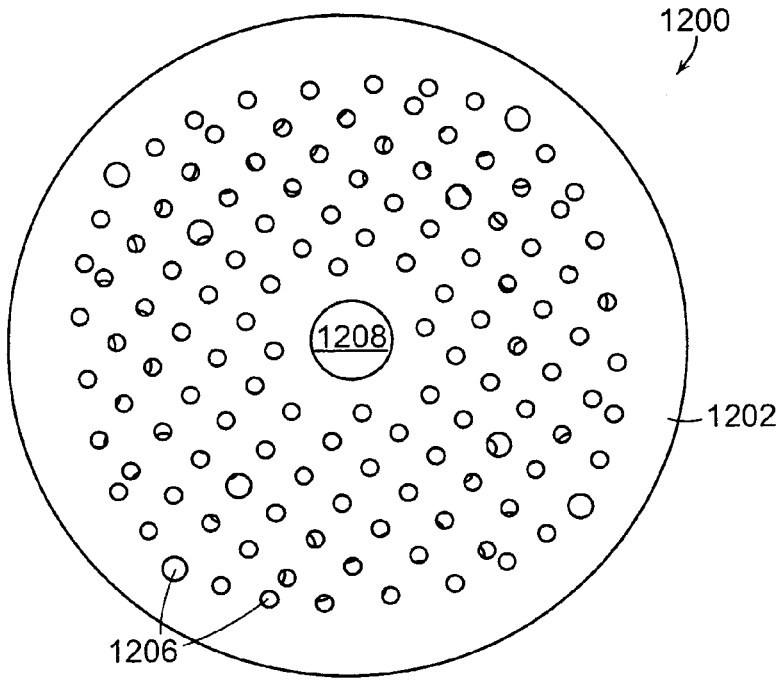
FIGS. 11A and 11B are views of an interface pad according to one embodiment of the present invention.
Figure 11B:
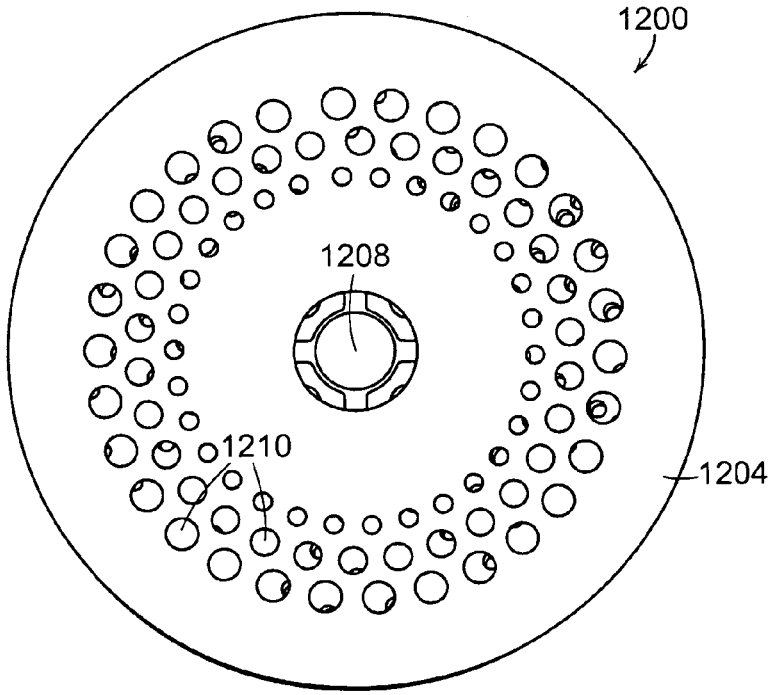

FIGS. 11A and 11B are views of an interface pad according to one embodiment of the present invention. Interface pad 1200 includes abrasive article backing support 1202 which includes a hook fastener component and support tool backing surface 1204 which includes a loop fastener component. Abrasive article backing support 1202 defines apertures 1206 and central hole 1208. Support tool backing surface 1204 defines apertures 1210 and central hole 1208. Sandwiched between abrasive article backing support 1202 and support tool backing surface 1204 is a channel-containing layer.

Figure 12A:
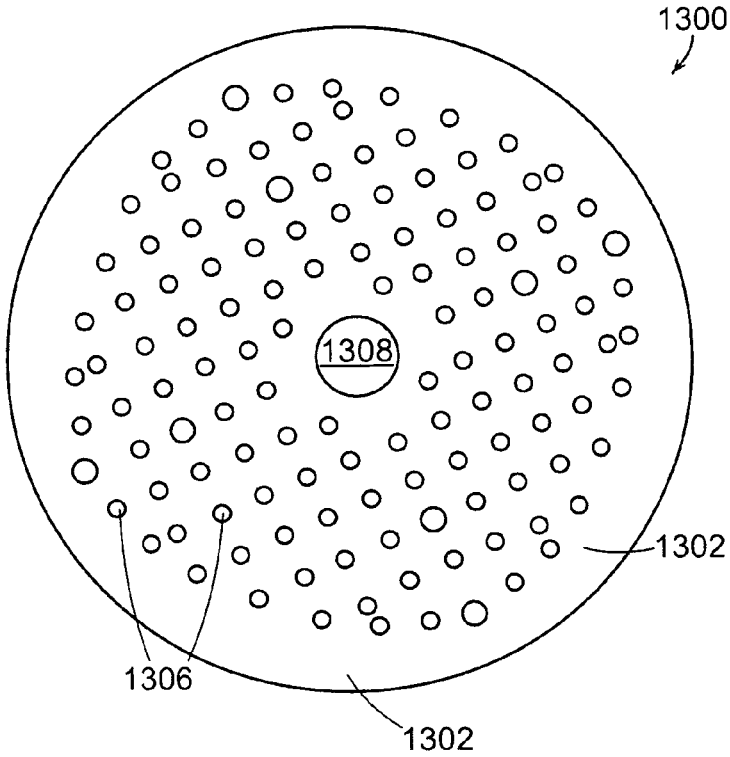
FIGS. 12A and 12B are views of an interface pad according to one embodiment of the present invention.
Figure 12B:
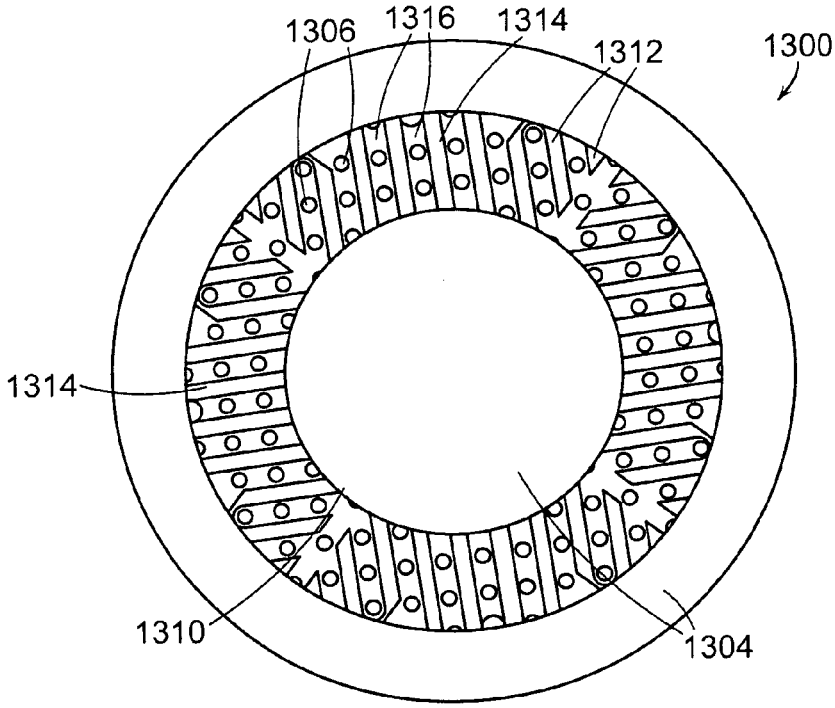

FIGS. 12A and 12B are views of an interface pad according to one embodiment of the present invention. Interface pad 1300 includes abrasive article backing support 1302 which includes a hook fastener component and support tool backing surface 1304 which includes a loop fastener component. Abrasive article backing support 1302 defines apertures 1306 and central hole 1308. Support tool backing surface 1204 defines ring-shaped aperture 1310. Sandwiched between abrasive article backing support 1302 and support tool backing surface 1304 is channel-containing layer 1312. Channel-containing layer 1312 includes support structures 1314 and defines channels 1316. Channels 1316 are in fluid communication with apertures 1306 and ring-shaped aperture 1310.

In one embodiment, the invention is a kit that includes a perforated abrasive article defining at least one aperture and including an abrasive surface and a backing surface. The kit also includes at least one interface pad that is fixable to the backing surface of the abrasive article. In a specific embodiment, the perforated abrasive article defines at least two apertures. Optionally, the kit includes at least one interface pad that defines an aperture that, when the interface pad is affixed to the backing surface, causes at least a portion of the perforations of the abrasive article to be in fluid communication with each other when a planar support tool backing surface is applied to the interface pad. As another option, the kit can include at least two interface pads which, when affixed to the backing surface, and when a support tool backing surface is applied to the interface pads, define in at least one conduit that provides fluid communication between at least two apertures of the abrasive article.

In another embodiment, at least one of the interface pad and the abrasive article include an adhesive at a surface that fixes the interface pad to the abrasive article. Alternatively, or optionally, the interface pad is releaseably fixable to the backing surface of the abrasive article. For example, the interface pad can be releaseably fixable by means of hook-and-loop surfaces at the interface pad and backing surface of the abrasive article.

Figure 13A:
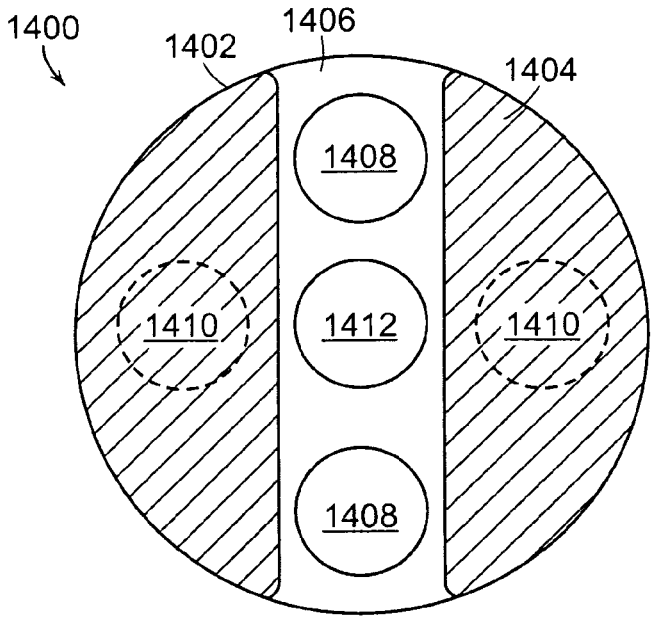
FIGS. 13A and 13B are views of a kit according to one embodiment of the present invention.
Figure 13B:
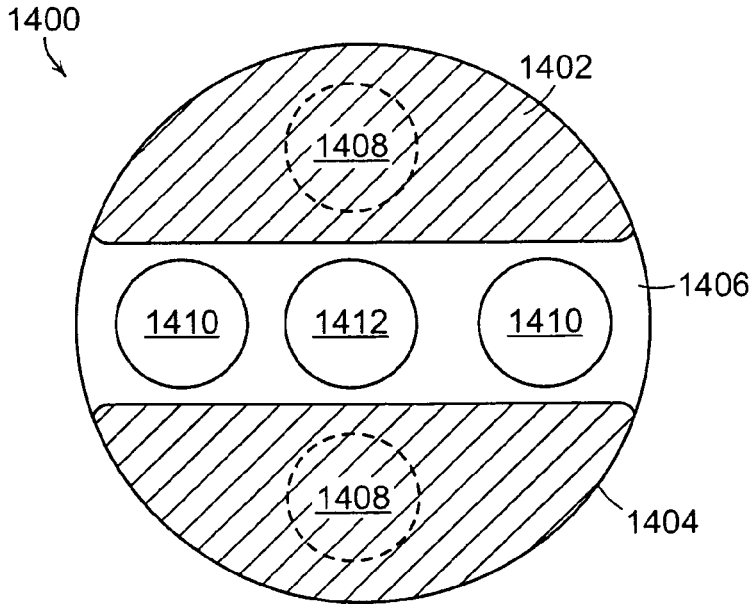
Figure 14A:
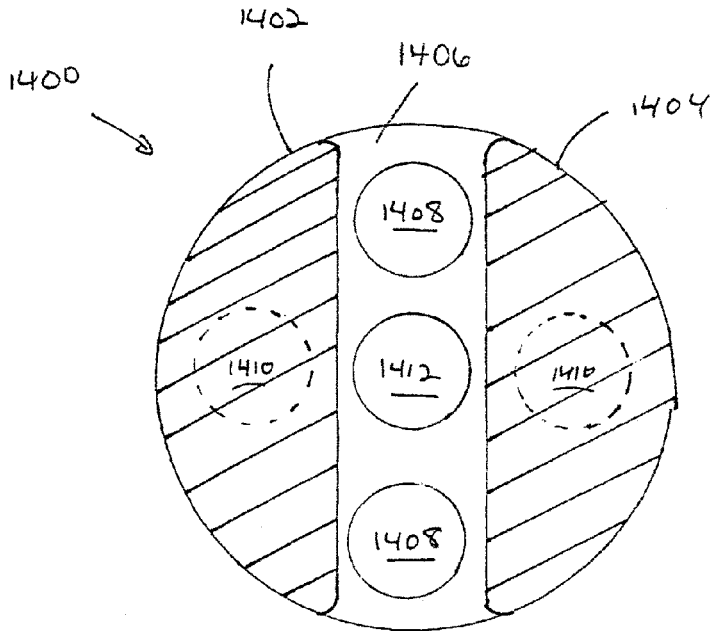
Figure 14B:
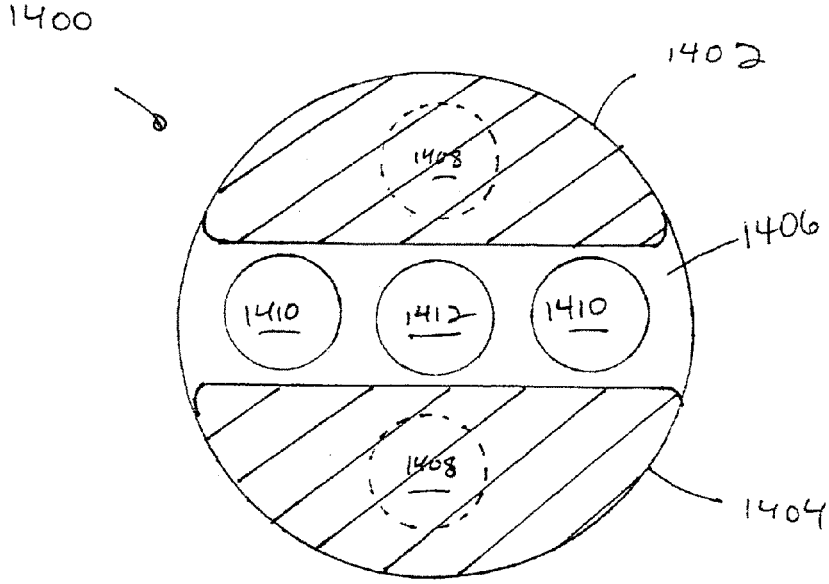

In still another embodiment, the interface pads of the kit can be affixed to the backing surface of the abrasive pad in alternative patterns that define distinct pathways of fluid communication between perforations of the abrasive article when a support tool is applied to the interface pads. In one embodiment, the alternative patterns define distinct pathways between different combinations of perforations of the abrasive article. For example, as shown in FIGS. 13A and 13B, kit 1400 includes interface pads 1402, 1404, which can be selectively applied to backing surface 1406 of an abrasive article in different patterns, to provide fluid communication between different aperture combinations 1408, 1410 around central hole 1412 when a support tool is applied to the interface pads. This embodiment is useful when different rates of flow through the abrasive article may be preferable, and can be effected where, for example, apertures 1408 have a different total aperture area than apertures 1410.

The present invention also can include a kit containing at least one perforated abrasive article (e.g., a perforated coated abrasive article) and at least one interface pad. In some embodiments, such a kit can contain a variety of perforated abrasive articles for use in a variety of applications or having a variety of perforation configurations. Such a kit can also, or alternatively, contain a variety of interface pads for use with a variety of perforated abrasive articles. In some embodiments, the kit includes a plurality of perforated abrasive articles and at least one interface pad. In additional embodiments, the kit includes a plurality of perforated abrasive articles and a plurality of interface pads.

A kit can include, for example, (a) at least one perforated abrasive article and (b) at least one interface pad wherein each interface pad includes (i) an abrasive article backing surface defining a second plurality of apertures; (ii) a plurality of islands underlying the abrasive article backing surface, the islands defining at least one channel in fluid communication with at least two of the second plurality of apertures; and (iii) a support tool backing surface underlying the plurality of islands; wherein at least one interface pad is positionable between at least one perforated abrasive article and a support tool defining a third plurality of apertures. Typically, the first plurality of apertures is not directly alignable with the third plurality of apertures when the perforated abrasive article and the support tool are brought together. In some instances, the first plurality of apertures differ from the third plurality of apertures in a manner selected from the group consisting of size, shape, orientation, position, or combinations thereof. In preferred embodiments, at least two of the first plurality of apertures are at least partially aligned with at least two of the second plurality of apertures when the interface pad is positioned between the perforated abrasive article and the support tool.

The present invention also includes methods for using a perforated abrasive article (e.g., a perforated coated abrasive article) with a support tool. For example, a method for using a perforated abrasive article defining a first plurality of apertures with a support tool defining a second plurality of apertures can include positioning an interface pad described herein between the perforated abrasive article and the support tool. In one example embodiment, the interface pad includes (a) an abrasive article backing surface defining a third plurality of apertures; (b) a plurality of islands underlying the abrasive article backing surface, the islands defining at least one channel in fluid communication with at least two of the third plurality of apertures; and (c) a support tool backing surface underlying the plurality of islands.

Typically, the first plurality of apertures is not directly alignable with the second plurality of apertures when the perforated abrasive article and the support tool are brought together. In some instances, the first plurality of apertures differ from the second plurality of apertures in a manner selected from the group consisting of size, shape, orientation, position, or combinations thereof. Preferably, at least two of the first plurality of apertures are at least partially aligned with at least two of the third plurality of apertures when the interface pad is positioned between the perforated abrasive article and the support tool.

The present invention also includes methods for abrading a surface using the abrasive tools described herein. For example, in some embodiments, a working surface is contacted with an abrasive tool and swarf is produced. The swarf can be conducted through an abrasive article, through an interface pad, and into a support tool. For example, in one embodiment, an abrasive tool includes (a) a perforated abrasive article defining a first plurality of apertures; (b) an interface pad including an abrasive article backing surface defining a second plurality of apertures and at least one channel in fluid communication with at least two of the second plurality of apertures; and (c) a support tool defining a third plurality of apertures and the swarf is conducted through the first plurality of apertures, through the second plurality of apertures, through the channel; and through the third plurality of apertures. Preferably, apertures and channels of the interface pad are configured such that swarf produced during the abrasion process can be effectively transported through the abrasive article backing surface's apertures and through the channels to reach the support tool's dust extraction system.

The interface pads and abrasive tools described herein can be used in a multitude of applications such as, but not limited to, abrasion of paint, coatings, fillers, composite materials (e.g., fiberglass and carbon fiber), wood, metal, plastic, plaster, and other such materials. The interface pads and abrasives tools described herein can be suitable for use in such fields and industries as construction, manufacturing, automotive, aerospace, marine, furniture making and refinishing, and service and maintenance industries, and also for use in crafts and hobbies and for consumer use.

While this invention has been particularly shown and described with references to example embodiments thereof, it will be understood by those skilled in the art that various changes in form and details may be made therein without departing from the scope of the invention encompassed by the appended claims.

What is claimed is:

1. An interface pad for use between a perforated abrasive article and a support tool, comprising:

a) an abrasive article backing surface defining a plurality of apertures;

b) a plurality of islands underlying the abrasive article backing surface, the islands defining at least one channel in fluid communication with at least two of the plurality of apertures; and c) a support tool backing surface underlying the plurality of islands, wherein the interface pad is disc-shaped, wherein the plurality of islands define a plurality of concentric channels, and wherein the plurality of islands also define at least one connection channel in fluid communication with at least two concentric channels.

2. The interface pad of claim 1 wherein the islands are composed of a polymer material.

3. The interface pad of claim 2 wherein the polymer material includes a polymer foam.

4. The interface pad of claim 2 wherein the polymer material includes polyurethane.

5. The interface pad of claim 1 wherein the abrasive article backing surface and the plurality of islands include the same material.

6. The interface pad of claim 1 wherein the abrasive article backing surface includes a hook or loop fastener component.

7. The interface pad of claim 1 wherein the interface pad is rectangular.

8. The interface pad of claim 1 wherein the interface pad is three-sided.

9. The interface pad of claim 1 wherein the interface pad is iron-shaped.

10. The interface pad of claim 1 wherein the interface pad is leaf-shaped.

11. The interface pad of claim 1 wherein the plurality of islands is concentric ridges underlying the abrasive article backing surface.

12. The interface pad of claim 1 wherein the islands define a plurality of channels in fluid communication with each of the plurality of apertures.

13. The interface pad of claim 1 wherein at least one channel is a non-torturous channel.

14. The interface pad of claim 1 wherein at least a portion of the plurality of apertures of the abrasive article backing surface are positioned for alignment with at least a portion of perforations of the perforated abrasive article.

15. The interface pad of claim 1 wherein at least one channel defined by the islands is positioned for alignment with at least one dust collection aperture defined by the support tool.

16. The interface pad of claim 1 wherein the support tool backing surface is molded into a surface of at least one of the plurality of islands.

17. The interface pad of claim 1 wherein the support tool backing surface and the plurality of islands include the same material.

18. The interface pad of claim 1 wherein the support tool backing surface includes a hook or loop fastener component.

19. The interface pad of claim 1 wherein the abrasive article backing surface is directly adjacent to the plurality of islands underlying the abrasive article backing surface.

20. The interface pad of claim 1 wherein the plurality of islands underlying the abrasive article backing surface is directly adjacent to the support tool backing surface.

21. The interface pad of claim 1 wherein the plurality of islands are connected to the abrasive article backing surface with an adhesive.

22. The interface pad of claim 1 wherein the plurality of islands are integral to the abrasive article backing surface.

23. The interface pad of claim 1 wherein the plurality of islands are connected to the support tool backing surface with an adhesive.

24. The interface pad of claim 1 wherein the plurality of islands are integral to the support tool backing surface.

25. The interface pad of claim 1 wherein at least one channel is in fluid communication with more than two of the apertures defined by the abrasive article backing surface.

26. An interface pad for use between a perforated abrasive article and a support tool, comprising:

a) an abrasive article backing surface defining a plurality of apertures;

b) a plurality of islands underlying the abrasive article backing surface, the islands defining at least one channel in fluid communication with at least two of the plurality of apertures; and c) a support tool backing surface underlying the plurality of islands, wherein substantially all of the apertures defined by the abrasive article backing surface are in fluid communication with each other via at least one channel defined by the islands.

27. The interface pad of claim 1 wherein the support tool backing surface defines a plurality of apertures.

28. The interface pad of claim 1 wherein at least one channel is in fluid communication with a plurality of the apertures defined by the support tool backing surface.

29. An interface pad for use between a perforated abrasive article and a support tool, comprising:

a) an abrasive article backing surface defining a plurality of apertures;

b) a plurality of islands underlying the abrasive article backing surface, the islands defining at least one channel in fluid communication with at least two of the plurality of apertures; and c) a support tool backing surface underlying the plurality of islands, wherein substantially all of the apertures defined by the support tool backing surface are in fluid communication with each other via at least one channel defined by the islands.

30. The interface pad of claim 1 wherein at least a portion of the plurality of apertures defined by the support tool backing surface are positioned for alignment with at least one dust collection aperture defined by the support tool.

31. An interface pad for use between a perforated abrasive article and a support tool, comprising:

a) an abrasive article backing surface defining a plurality of apertures;

b) a plurality of islands underlying the abrasive article backing surface, the islands defining at least one channel in fluid communication with at least two of the plurality of apertures; and c) a support tool backing surface underlying the plurality of islands, wherein the plurality of apertures defined by the abrasive article backing surface are individually arc-shaped.

32. The interface pad of claim 1 wherein and the plurality of apertures defined by the abrasive article backing surface are symmetric about at least one axis of symmetry.

33. An interface pad for use between a perforated abrasive article and a support tool, comprising:

a) an abrasive article backing surface defining a plurality of apertures;

b) a plurality of islands underlying the abrasive article backing surface, the islands defining at least one channel in fluid communication with at least two of the plurality of apertures; and c) a support tool backing surface underlying the plurality of islands, wherein the interface pad is disc-shaped, the support tool backing surface defines a plurality of apertures, and the plurality of apertures defined by the support tool backing surface are radially symmetric, and wherein the plurality of apertures defined by the support tool backing surface are individually arc-shaped.

34. The interface pad of claim 1 wherein and the plurality of apertures defined by the support tool backing surface are symmetric about at least one axis of symmetry.

35. An interface pad for use between a perforated abrasive article and a support tool, comprising:

a) an abrasive article backing surface defining a plurality of apertures;

b) a plurality of islands underlying the abrasive article backing surface, the islands defining at least one channel in fluid communication with at least two of the plurality of apertures; and c) a support tool backing surface underlying the plurality of islands, wherein the plurality of islands underlying the abrasive article backing surface includes an island underlying a perimeter of the abrasive article backing surface, and wherein the island underlying a perimeter of the abrasive article backing surface includes at least one peninsula underlying the abrasive article surface and extending generally from a perimeter of the interface pad toward a center of the interface pad.

36. The interface pad of claim 35 wherein the support tool backing surface underlies and is affixed to at least the island underlying the perimeter of the abrasive article backing surface.

37. An interface pad for use between a perforated abrasive article and a support tool, comprising:

a) an abrasive article backing surface defining a plurality of apertures;

b) a channel-containing layer underlying the abrasive article backing surface, the channel-containing layer defining at least one channel in fluid communication with at least two of the plurality of apertures; and c) a support tool backing surface underlying the channel-containing layer, wherein the channel-containing layer defines at least one branched channel.

38. The interface pad of claim 37 wherein the channel-containing layer is attached to the abrasive article backing surface with an adhesive.

39. The interface pad of claim 37 wherein the channel-containing layer is integral with the abrasive article backing surface.

40. The interface pad of claim 37 wherein the channel-containing layer is attached to the support tool backing surface with an adhesive.

41. The interface pad of claim 37 wherein the channel-containing layer is integral with the support tool backing surface.

42. The interface pad of claim 37 wherein the support backing tool defines a plurality of apertures.

43. The interface pad of claim 42 wherein at least one channel of the channel-containing layer is in fluid communication with at least two of the plurality of apertures defined by the support backing tool.

44. The interface pad of claim 37 wherein at least one channel defined by the channel-containing layer is positioned for alignment with at least one dust collection aperture defined by the support tool.

45. An interface pad for use between a perforated abrasive article and a support tool, comprising:

a) an abrasive article backing surface defining a plurality of apertures;

b) a channel-containing layer underlying the abrasive article backing surface, the channel-containing layer defining at least one channel in fluid communication with at least two of the plurality of apertures; and c) a support tool backing surface underlying the channel-containing layer, wherein the channel-containing layer defines branched and straight channels.

46. The interface pad of claim 37 wherein the channel-containing layer defines at least one non-torturous channel.

47. The interface pad of claim 37 wherein the channel-containing layer includes a plurality of islands which define the channel in fluid communication with at least two of the plurality of apertures.

* * * * *

UNITED STATES PATENT AND TRADEMARK OFFICE

CERTIFICATE OF CORRECTION

PATENT NO. : 8,444,454 B2
APPLICATION NO. : 12/317709
DATED : May 21, 2013
INVENTOR(S) : Mervyn Chung-Fat et al.

It is certified that error appears in the above-identified patent and that said Letters Patent is hereby corrected as shown below:

In the Claims, column 21, line 44, claim 31, please insert: --wherein the interface pad is disc-shaped and the plurality of apertures defined by the abrasive article backing surface are radially symmetric, and--

Signed and Sealed this
Seventeenth Day of February, 2015

Michelle K. Lee

Michelle K. Lee
*Deputy Director of the United States Patent and Trademark Office*